US012060875B2

(12) United States Patent
Babbitt et al.

(10) Patent No.: US 12,060,875 B2
(45) Date of Patent: Aug. 13, 2024

(54) HYDRAULIC DRIVE FOR DIAPHRAGM COMPRESSOR

(71) Applicant: PDC MACHINES INC., Warminster, PA (US)

(72) Inventors: Guy Babbitt, Fort Collins, CO (US); Chris Turner, Windsor, CO (US); Bryce Whitehill, Fort Collins, CO (US); Michael Sprengel, Fort Collins, CO (US); Noah Schaich, Fort Collins, CO (US); Kyle Palmiscno, Loveland, CO (US); Alex Beckerman, Tucson, AZ (US); Kareem Afzal, Gwynedd, PA (US); Carl T. Johnson, Fort Collins, CO (US)

(73) Assignee: PDC Machines Inc., Warminster, PA (US)

( * ) Notice: Subject to any disclaimer, the term of this patent is extended or adjusted under 35 U.S.C. 154(b) by 91 days.

(21) Appl. No.: 17/522,896

(22) Filed: Nov. 9, 2021

(65) Prior Publication Data

US 2023/0146011 A1 May 11, 2023
US 2024/0117802 A9 Apr. 11, 2024

Related U.S. Application Data

(60) Provisional application No. 63/277,125, filed on Nov. 8, 2021, provisional application No. 63/111,356, filed on Nov. 9, 2020.

(51) Int. Cl.
*F04B 45/053* (2006.01)
*F04B 39/02* (2006.01)
(Continued)

(52) U.S. Cl.
CPC ..... *F04B 45/053* (2013.01); *F04B 39/02* (2013.01); *F04B 39/06* (2013.01); *F04B 39/16* (2013.01);
(Continued)

(58) Field of Classification Search
CPC ..... F04B 43/10; F04B 2205/05; F04B 2201/0202; F04B 2201/0201; F04B 53/14;
(Continued)

(56) References Cited

U.S. PATENT DOCUMENTS 3,234,882 A 2/1966 Douglas et al.
3,286,640 A 11/1966 Bauer
(Continued)

FOREIGN PATENT DOCUMENTS

CN 203548120 U 4/2014
CN 205654517 U 10/2016
(Continued)

OTHER PUBLICATIONS

International Search Report and Written Opinion for PCT/US2021/058684 dated Feb. 2, 2022.
(Continued)

*Primary Examiner* — Connor J Tremarche
(74) *Attorney, Agent, or Firm* — Reed Smith LLP; Matthew P. Frederick; Travis J. Sumpter

(57) ABSTRACT

Devices and methods for operating a diaphragm compressor. Embodiments of the present disclosure comprise an oil piston being driven to pressurize work oil against the diaphragm of the compressor. In embodiments, an injection pump provides a supplemental flow of work oil in the region of pressurized fluid, and such pump may be part of an actively controlled system. In embodiments, a pressure relief valve vents an overpump flow of work oil, and such valve
(Continued)

may be variable. Embodiments provide feedback and control mechanisms, including control of the injection pump and the relief valve.

20 Claims, 26 Drawing Sheets

(51) Int. Cl.

| | |
|---|---|
| ***F04B 39/06*** | (2006.01) |
| ***F04B 39/16*** | (2006.01) |
| ***F04B 43/073*** | (2006.01) |
| ***F04B 45/04*** | (2006.01) |
| ***F04B 49/22*** | (2006.01) |
| ***F04B 53/06*** | (2006.01) |
| ***F04B 53/14*** | (2006.01) |
| *F04B 53/08* | (2006.01) |

(52) U.S. Cl.
CPC ..... *F04B 43/073* (2013.01); *F04B 45/043* (2013.01); *F04B 45/0533* (2013.01); *F04B 45/0536* (2013.01); *F04B 49/22* (2013.01); *F04B 53/06* (2013.01); *F04B 53/14* (2013.01); *F04B 53/08* (2013.01); *F04B 2201/0201* (2013.01); *F04B 2201/0202* (2013.01); *F04B 2205/05* (2013.01)

(58) Field of Classification Search
CPC ..... F04B 53/06; F04B 49/22; F04B 43/073; F04B 45/0536; F04B 45/043; F04B 45/0533
See application file for complete search history.

(56) References Cited

U.S. PATENT DOCUMENTS

| | | | | |
|---|---|---|---|---|
| 3,625,254 | A | 12/1971 | Rice | |
| 3,790,125 | A | 2/1974 | Swatty | |
| 3,804,162 | A | 4/1974 | Kugler et al. | |
| 4,213,298 | A | 7/1980 | Milgram | |
| 4,381,180 | A | 4/1983 | Sell | |
| 4,450,685 | A | 5/1984 | Corey | |
| 4,565,501 | A | 1/1986 | Laurendeau et al. | |
| 4,854,832 | A | 8/1989 | Gardner et al. | |
| 5,020,974 | A | 6/1991 | Searle | |
| 5,106,274 | A | 4/1992 | Holtzappie | |
| 5,326,234 | A | 7/1994 | Versaw et al. | |
| 5,531,013 | A | 7/1996 | Nakamura | |
| 6,004,105 | A | 12/1999 | Reynolds | |
| 6,206,664 | B1 | 3/2001 | Kakizawa | |
| 9,022,746 | B2 | 5/2015 | Kroupa et al. | |
| 11,174,854 | B2 | 11/2021 | Hines et al. | |
| 2002/0164255 | A1 | 11/2002 | Burr et al. | |
| 2003/0123991 | A1 | 7/2003 | Chen et al. | |
| 2003/0170126 | A1 | 9/2003 | Klelbrink | |
| 2004/0241544 | A1 | 12/2004 | Nakaishi et al. | |
| 2005/0288834 | A1 | 12/2005 | Heiniger et al. | |
| 2006/0201148 | A1 | 9/2006 | Zabtcioglu | |
| 2008/0056916 | A1* | 3/2008 | Ferk | F04B 43/067 417/395 |
| 2009/0196771 | A1 | 8/2009 | Juterbock et al. | |
| 2010/0186433 | A1 | 7/2010 | Galante et al. | |
| 2012/0097121 | A1 | 4/2012 | Brennan et al. | |
| 2013/0101445 | A1* | 4/2013 | Schutze | F04B 43/073 417/395 |
| 2014/0323791 | A1 | 10/2014 | Das et al. | |
| 2015/0004003 | A1 | 1/2015 | Roberts et al. | |
| 2015/0240799 | A1 | 8/2015 | Obrejanu et al. | |
| 2015/0285238 | A1* | 10/2015 | Lynn | F04B 53/16 417/274 |
| 2016/0169218 | A1 | 6/2016 | Elliot et al. | |
| 2016/0319810 | A1 | 11/2016 | Gibbs | |
| 2017/0009760 | A1 | 1/2017 | Lutz et al. | |
| 2018/0135616 | A1 | 5/2018 | Adams et al. | |
| 2018/0314274 | A1 | 11/2018 | Gibbs | |
| 2020/0191174 | A1 | 6/2020 | Tam et al. | |
| 2021/0148354 | A1 | 5/2021 | Adams | |
| 2022/0080537 | A1 | 3/2022 | Inoue et al. | |

FOREIGN PATENT DOCUMENTS

| | | | | |
|---|---|---|---|---|
| EP | 3643931 | A1 | 4/2020 | |
| GB | 2190712 | A * | 11/1987 | F04B 43/067 |
| WO | WO 2012167959 | A1 | 12/2012 | |
| WO | WO 2016077751 | A1 | 5/2016 | |
| WO | WO 2017137498 | A1 | 8/2017 | |
| WO | WO 2019011385 | A1 | 1/2019 | |
| WO | WO 2022099220 | A1 | 5/2022 | |

OTHER PUBLICATIONS

International Search Report and Written Opinion for PCT/US22/33565 dated Sep. 13, 2022.
International Search Report and Written Opinion for PCT/US22/33570 dated Sep. 21, 2022.
International Search Report and Written Opinion for PCT/US22/33574 dated Sep. 21, 2022.
International Search Report and Written Opinion for PCT/US21/58683 dated Feb. 4, 2022.
International Search Report and Written Opinion for PCT/US22/49333 dated Feb. 17, 2023.

* cited by examiner

HYDRAULIC DRIVE FOR DIAPHRAGM COMPRESSOR

CROSS-REFERENCE TO RELATED APPLICATIONS

This application claims the benefit under 35 U.S.C. § 119(e) of the earlier filing date of U.S. Provisional Patent Applications No. 63/111,356 filed on Nov. 9, 2020 and No. 63/277,125 filed on Nov. 8, 2021, the disclosures of which are incorporated herein by reference in their entirety.

This application is related to co-pending and co-owned U.S. patent application Ser. No. 17/522,892 entitled "Active Oil Injection System For A Diaphragm Compressor", filed on Nov. 9, 2021, which is incorporated herein by reference in its entirety.

FIELD OF THE INVENTION

The present invention is directed to a diaphragm compressor driven by a hydraulic drive system.

BACKGROUND OF THE INVENTION

A diaphragm compressor actuates a diaphragm at high speed to pressurize a process gas. A piston drives and intensifies a supply of work oil against the diaphragm.

SUMMARY OF THE INVENTION

In certain embodiments, a hydraulically-driven compressor system comprises one or more diaphragm compressor heads and a hydraulic drive. The diaphragm compressor heads each comprise a process gas head support plate, a work oil head support plate, a head cavity, and a metallic diaphragm. The process gas head support plate comprises a process gas inlet and a process gas outlet. The work oil head support plate comprises a piston cavity, an inlet, and an outlet. The head cavity is defined between the process gas head support plate and the work oil head support plate. the metallic diaphragm is mounted between the oil head support plate and the process gas head support plate. the metallic diaphragm divides the head cavity into a work oil region and a process gas region. The metallic diaphragm is configured to actuate from a first position to a second position during a discharge cycle to pressurize process gas in the process gas region from an inlet pressure to a discharge pressure and discharge the pressurized process gas through the outlet of the process gas head support plate. the metallic diaphragm is configured to move from the second position to the first position during a suction cycle to fill the process gas region with process gas at the inlet pressure. The hydraulic drive is configured to intensify work oil and provide the intensified work oil to the compressor head. The hydraulic drive comprises a drive housing, a hydraulic power unit, a plurality of pressure rails, and a piston subassembly. The drive housing defines a drive cavity, wherein the hydraulic drive is configured to provide a variable-pressure supply of work oil to the drive cavity. The plurality of pressure rails comprise a first pressure rail of work oil at a first pressure and a second pressure rail of work oil at a second pressure. The piston subassembly comprises a diaphragm piston and an actuator piston. The diaphragm piston is mounted in the drive cavity and comprises a first diameter. A first variable volume region comprises the work oil region of the compressor head and is defined between the diaphragm piston and the diaphragm of a corresponding compressor head. The actuator piston is located in the drive cavity and is coupled to the diaphragm piston. The actuator piston comprises an actuator diameter. During a discharge cycle of the diaphragm compressor head, the variable-pressure supply of work oil is configured to drive the actuator piston toward the diaphragm piston, driving the diaphragm piston toward the corresponding diaphragm compressor head, intensifying the work oil in the variable volume region to an intensified pressure, and actuating the diaphragm to the second position. Upon completion of the discharge cycle, the suction cycle is initiated due to one or more of: the intensified work oil in the first variable volume region decompressing, a supply of work oil from the first pressure rail being supplied to the drive cavity to act against the actuator piston, and a supply of process gas at the inlet pressure being supplied to the drive cavity to act against the actuator piston.

In certain embodiments, the first pressure rail comprises low-pressure work oil recovered from a previous cycle of the diaphragm compressor head.

In certain embodiments, the second pressure rail comprises medium-pressure work oil pressurized by the hydraulic power unit.

In certain embodiments, the plurality of pressure rails comprises a third pressure rail comprising high-pressure work oil pressurized by the hydraulic power unit.

In certain embodiments, the hydraulic drive is configured to provide the variable-pressure supply of work oil by supplying work oil from the third pressure rail after work oil has been supplied from the first and second pressure rails.

In certain embodiments, the hydraulic drive is configured to provide the variable-pressure supply of work oil by sequentially providing work oil to the drive cavity from the first pressure rail, the second pressure rail, and the third pressure rail.

In certain embodiments, the hydraulic drive further comprises a feedback mechanism is configured to adjust one or more of the pressure and timing of the variable-pressure supply of work oil.

In certain embodiments, the feedback mechanism comprises a sensor configured to detect one or more of the position and velocity of the actuator piston.

In certain embodiments, the first pressure rail comprises low-pressure work oil from an oil reservoir of the hydraulic drive. The hydraulic drive further comprises a passive first valve, an active second valve, and an active third valve. The passive first valve is configured to supply work oil from the first pressure rail to the drive cavity. The active second valve is configured to supply work oil from the second pressure rail to the drive cavity. The active third valve is configured to supply work oil from the third pressure rail to the drive cavity. One or more of the active second valve and the active third valve is configured to adjust from a supply stage to a return stage. The return stage permits an outflow of intensified work oil from the drive cavity or the variable volume region during the suction cycle of the compressor head.

In certain embodiments, the piston subassembly comprises a plurality of intermediate pistons configured to drive the diaphragm piston to intensify the work oil in the variable volume region.

In certain embodiments, the plurality of diaphragm pistons is axisymmetrically arranged about the actuator piston.

In certain embodiments, the hydraulically-driven compressor system further comprises an active oil injection system operatively coupled to the inlet of the work oil head support plate. the active oil injection system is configured to provide a supplemental supply of work oil to the variable volume region to maintain an overpump condition of the compressor head.

In certain embodiments, the hydraulically-driven compressor system further comprises a pressure relief valve operatively coupled to the outlet of the work oil head support plate. the pressure relief valve is configured to vent work oil from the variable volume to an oil reservoir. The first pressure rail comprises low-pressure work oil from the oil reservoir.

In certain embodiments, the supplemental work oil of the active oil injection system comprises work oil from the oil reservoir.

In certain embodiments, the one or more diaphragm compressor heads comprise a second diaphragm compressor head. The second diaphragm compressor head comprises a second metallic diaphragm. The second metallic diaphragm is configured to actuate from a first position to a second position during a second discharge cycle. The hydraulic drive is configured to intensify work oil and provide the intensified work oil to the second diaphragm compressor head during a second discharge cycle. The hydraulic drive further comprises the piston subassembly. The piston subassembly comprises a second diaphragm piston. The second diaphragm piston is mounted in the drive cavity and comprises a second diameter. A second variable volume region is defined between the second diaphragm piston and the second diaphragm of the second corresponding compressor head. The actuator diameter is greater than the second diameter. During a discharge cycle stroke of the second diaphragm piston and the second compressor head, the variable-pressure supply of work oil is configured to drive the actuator piston toward the second diaphragm piston, driving the second diaphragm piston toward the corresponding second diaphragm compressor head, intensifying the work oil in the second variable volume region to an intensified pressure, and actuating the second diaphragm to the second position.

In certain embodiments, the piston subassembly is configured to reciprocate between the discharge cycle of the compressor head and the second discharge cycle of the second compressor head. The second discharge cycle of the second compressor head is concurrent with the suction cycle of the first compressor head.

In certain embodiments, the second discharge cycle of the second compressor head is concurrent with the discharge cycle of the first compressor head.

In certain embodiments, the compressor head and the second compressor head are arranged on axially opposed sides of the drive housing.

In certain embodiments, the diaphragm piston and the second diaphragm piston are coaxial with the actuator piston.

In certain embodiments, the first diaphragm piston is operatively coupled to the actuator piston and the second diaphragm piston is operatively coupled to the actuator piston. During the suction cycle to fill the process gas region of the compressor head with process gas at the inlet pressure, the metallic diaphragm is configured to move to the first position and initiate movement of the diaphragm piston toward the second compressor head.

In embodiments, the hydraulic drive further comprises a hydraulic accumulator, the return stage of one or more of the second and third valves configured to supply the outflow of intensified work oil from the drive cavity to the hydraulic accumulator.

In embodiments, the hydraulic power unit comprises a medium-pressure accumulator corresponding to the second pressure rail and a high-pressure accumulator corresponding to the third pressure rail.

In embodiments, the hydraulic drive comprises a medium-pressure valve manifold mounting the second valve and a high-pressure valve manifold mounting the third valve, each of the medium- and high-pressure valve manifolds being mounted to the drive housing.

In embodiments, the drive cavity comprises first and second chambers, the actuator piston comprising a first actuator piston in the first chamber and a second actuator piston in the second chamber.

In embodiments, a force-bias mechanism is configured to provide stored energy to one or more of the first and second actuator pistons to initiate the discharge cycle.

In embodiments, the force-bias mechanism comprises a hydraulic accumulator operatively coupled to one or more of the first and second chamber, the hydraulic accumulator configured to store intensified work oil from a previous cycle of the hydraulic drive.

In embodiments, the hydraulic drive is configured to separately power one or more of the plurality of diaphragm pistons.

In embodiments, a first main stage valve is configured to, during the discharge cycle of the compressor head, provide the variable-pressure supply of work oil to a first axial side of the actuator piston; and a second main stage valve is configured to, during the suction cycle of the compressor head, provide the variable-pressure supply of work oil to a second axial side of the actuator piston.

DETAILED DESCRIPTION

Figure 1:
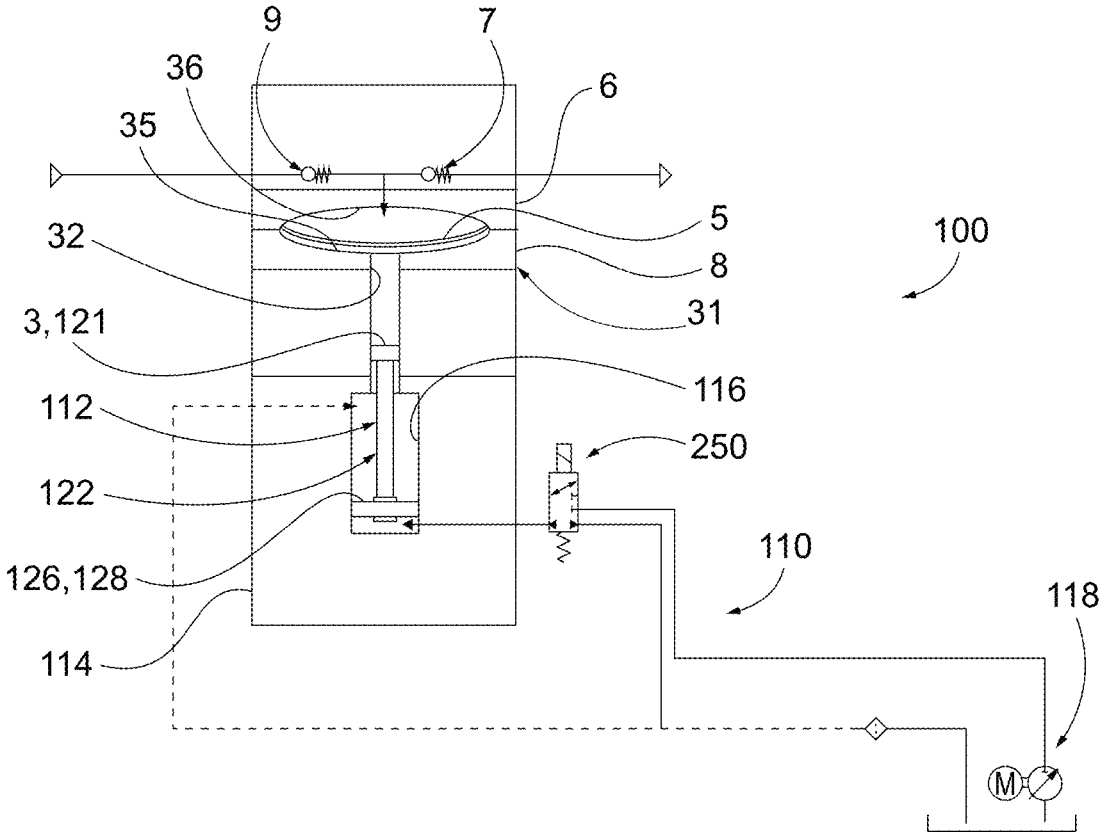
FIG. 1 is a schematic view of a hydraulically-driven compressor system in accord with embodiments of the present disclosure.

As shown in FIG. 1, embodiments of the compressor system 100 of the present disclosure includes a hydraulic drive 110 to power a diaphragm compressor 1 for a process gas. This architecture comprises a hydraulic drive 110, which may or may not act as a hydraulic intensifier, which is actuated to provide high pressure work oil to the diaphragm compressor 1. The controlled motion profile of the hydraulic drive pressurizes work oil below a diaphragm 5 of the compressor 1 thereby actuating the diaphragm 5 and pressurizing process gas which then flows out of a discharge check valve 7. In operation, embodiments of the present disclosure comprise a diaphragm piston 3 compressing and driving work oil to one side of a compressor diaphragm 5, the opposite end of the high-pressure oil piston being driven by the hydraulic drive 110.

Applicable to any embodiments disclosed herein, the terms "upward" and "downward" are used for convenience in reference to the figures for explaining examples of motion, but are not meant to be limiting. In embodiments, the diaphragm piston 3, diaphragm 5, and other components may move in any direction relative to each other, for example left and right, inward and outward, and the like. In embodiments, the diaphragm piston 3 may move perpendicularly or otherwise angled relative to the diaphragm 5 or to components of the actuator 110, so long as actuation movement of the diaphragm piston 3 pressurizes work oil against the diaphragm. In embodiments, the diaphragm piston 3 or intermediate pistons 183 may move in a direction away from or offset from the diaphragm 5. In other words, by referring to the movement of the piston as the terms "upward" and "downward" with respect to the diaphragm 5 or the compressor head, those terms may be understood as "toward" and "away from," respectively, or may understood as "pressurizing the work oil" and "depressurizing the work oil," respectively, or "discharge cycle" and "suction cycle," respectively.

Diaphragm Compressor

Figure 2:
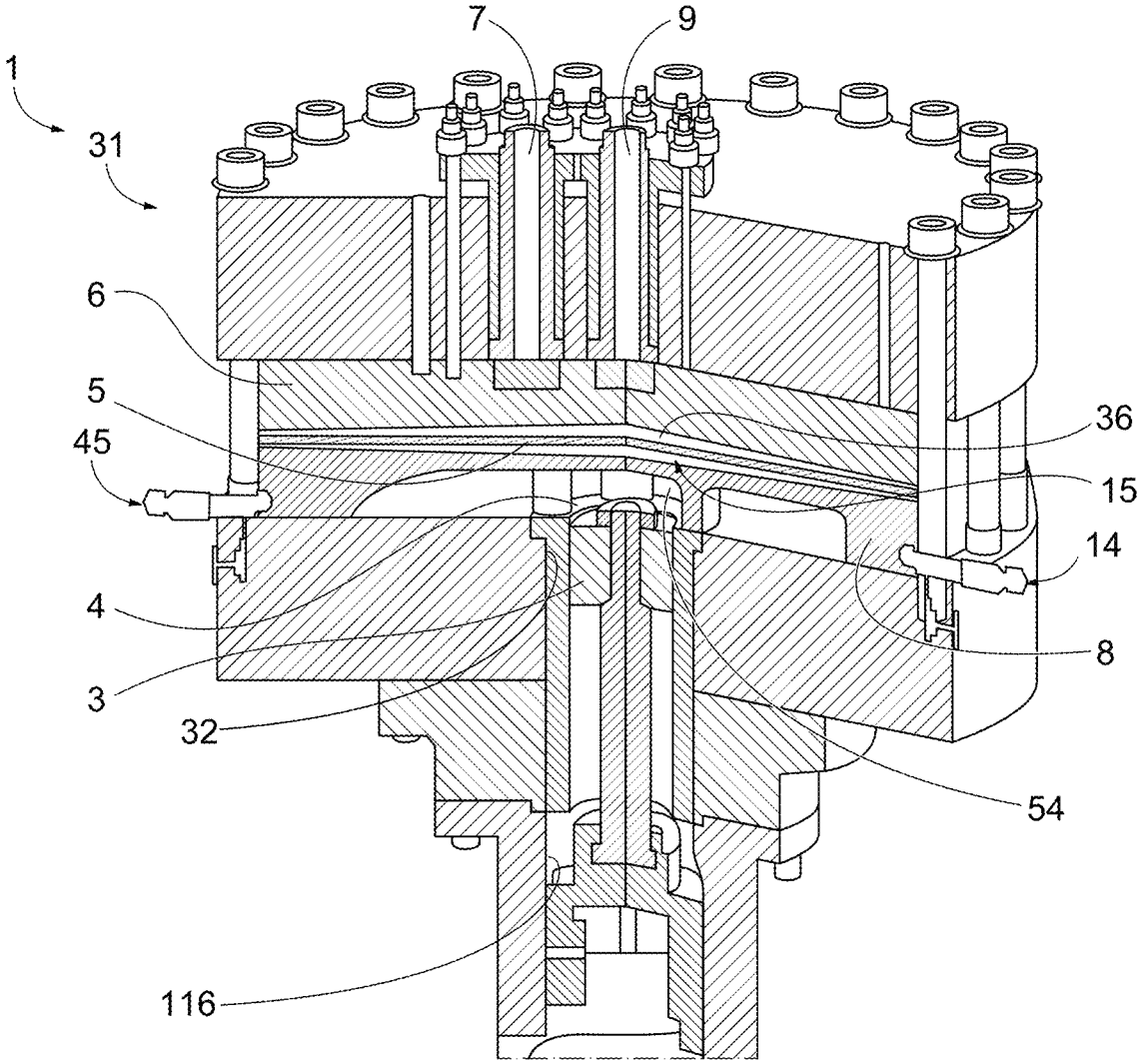
FIG. 2 is a sectional view of a compressor head of the compressor system of FIG. 1.
Figure 3:
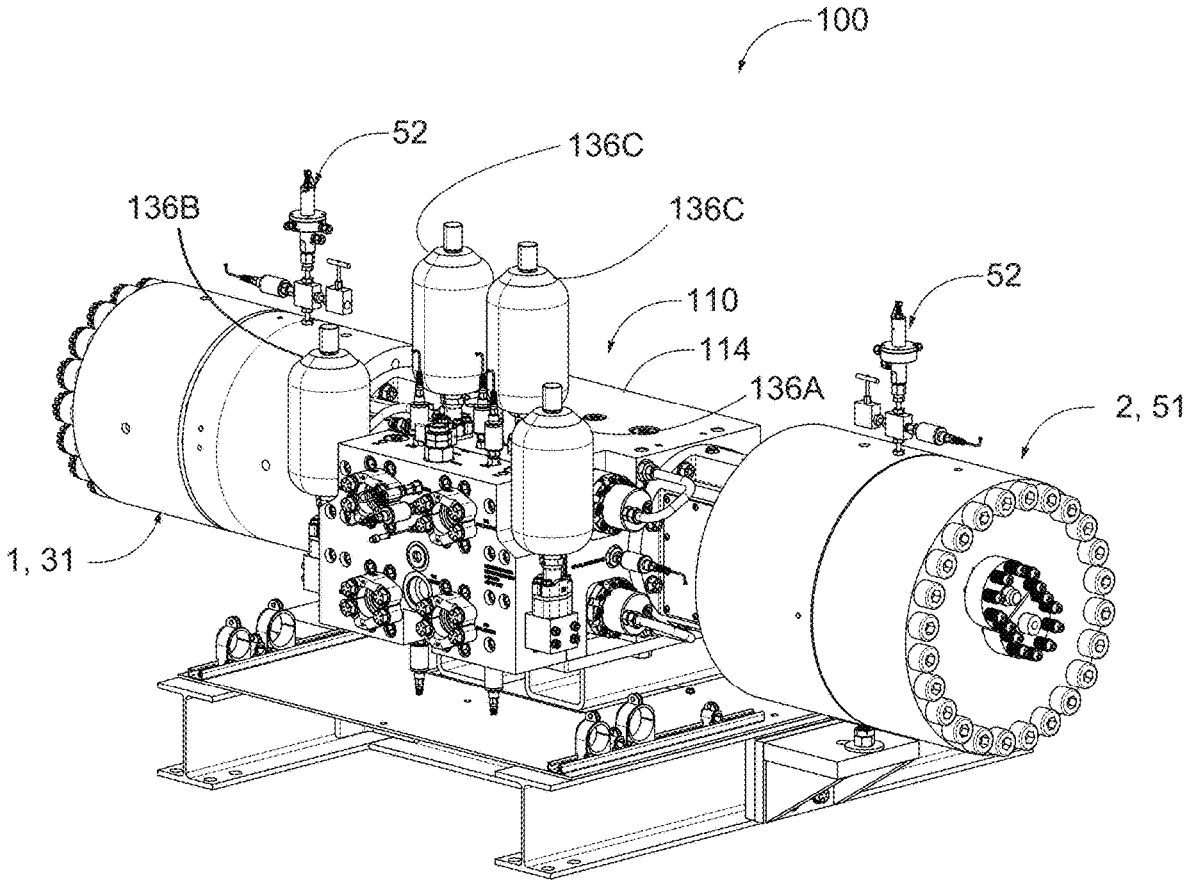
FIG. 3 is a side perspective view of a hydraulically-driven compressor system with two compressor heads in accord with embodiments of the present disclosure.
Figure 4:
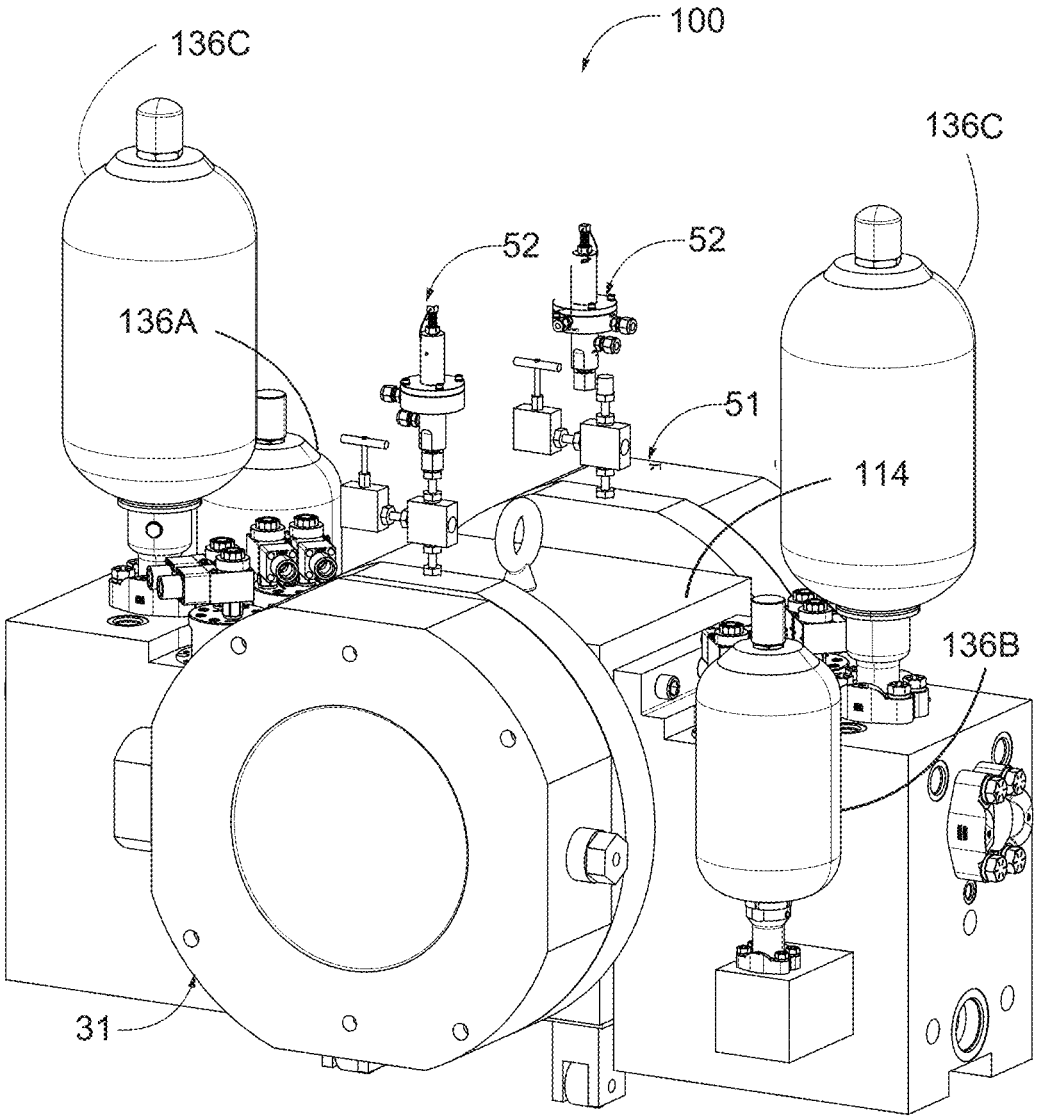
FIG. 4 is a side perspective view of a hydraulically-driven compressor system with two compressor heads in accord with embodiments of the present disclosure.
Figure 5:
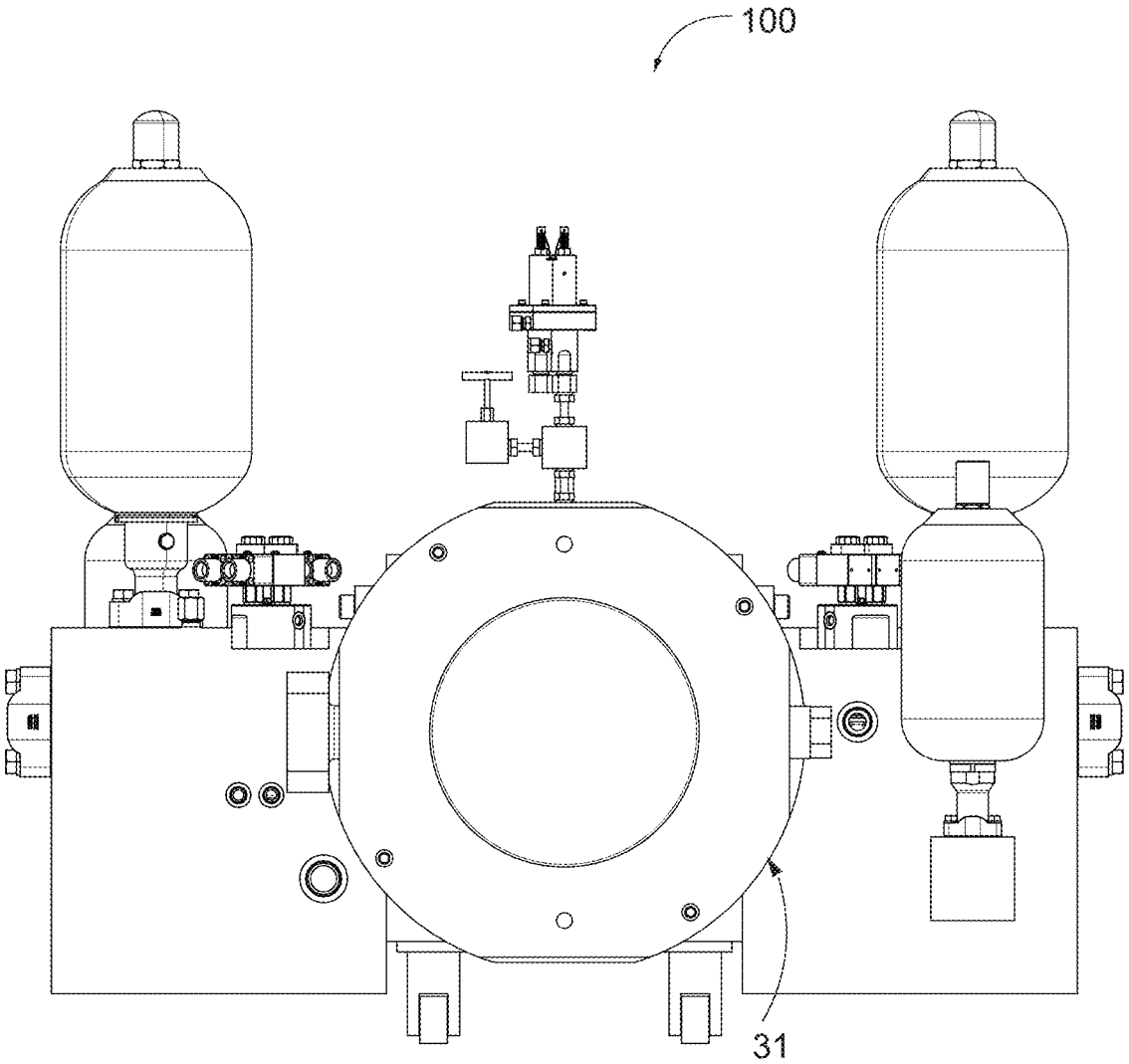
FIG. 5 is front elevation view of the compressor system of FIG. 4.
Figure 6:
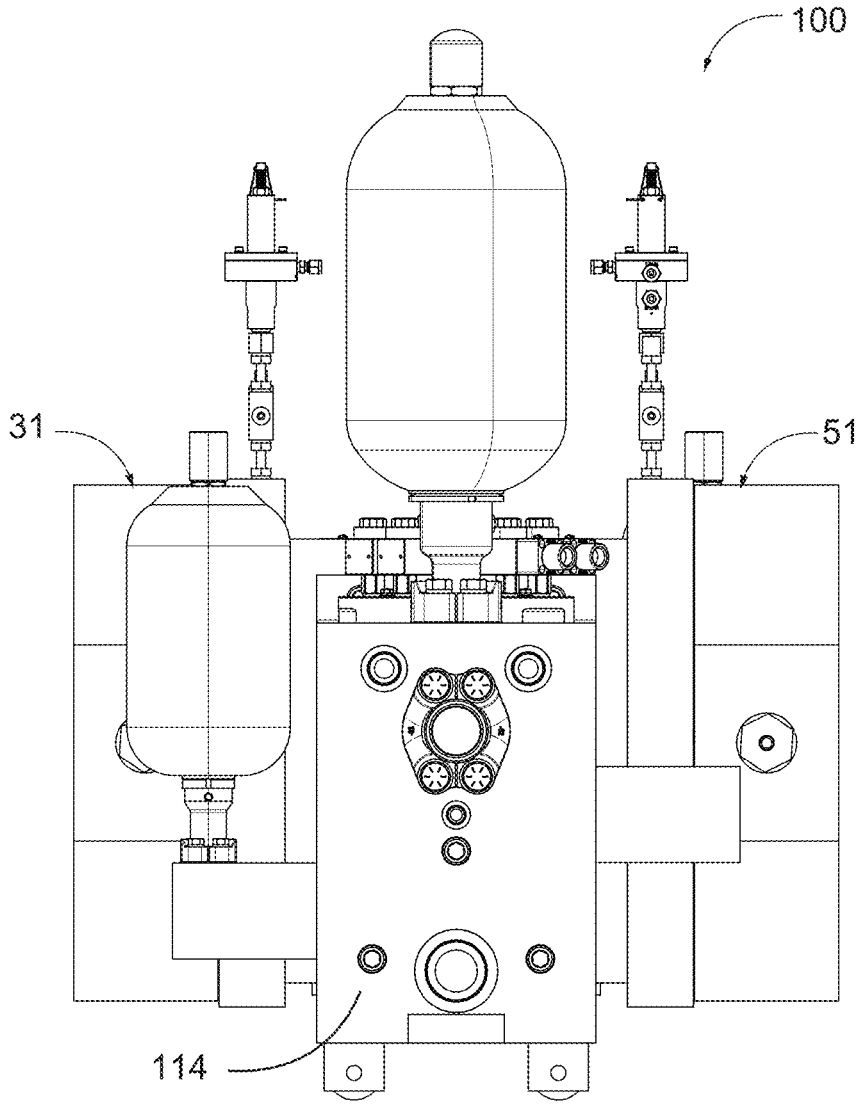
FIG. 6 is side elevation view of the compressor system of FIG. 4.
Figure 7:
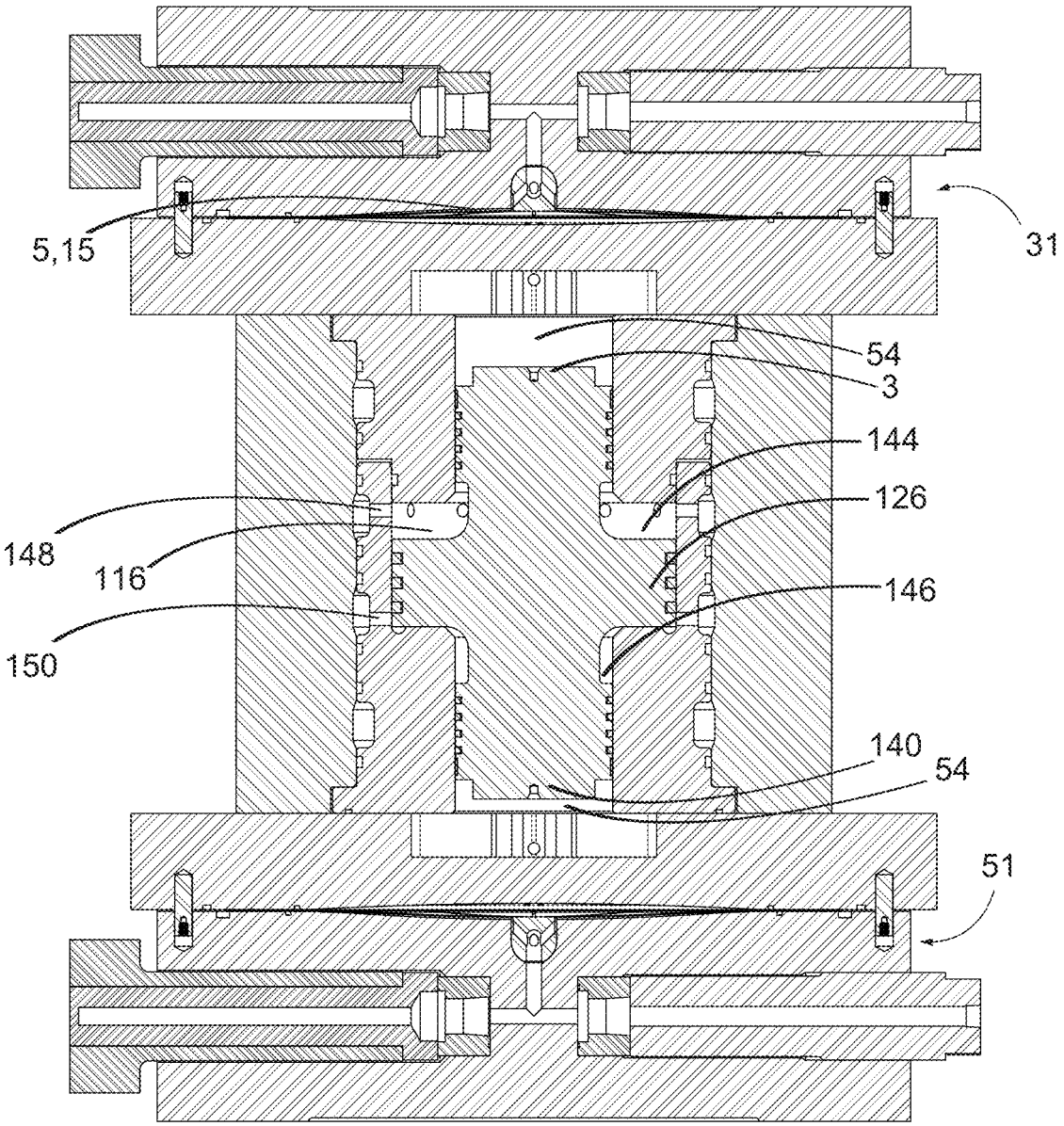
FIG. 7 is top sectional view of the compressor system of FIG. 4.

In some embodiments such as the one shown in FIG. 2, the diaphragm compressor 1 is driven by a high pressure oil piston 3 that moves a volume of work oil 4 (also referred to as hydraulic fluid) through the compressor 1 suction and discharge cycles. Process gas compression occurs as the volume of work oil is pushed towards the diaphragm 5 by the high pressure oil piston 3 to fill a work oil region 35 in the work oil head support plate 8 (or lower plate), exerting a uniform force against the bottom of the diaphragm 5. This deflects the diaphragm 5 into an upper cavity in the gas plate 6 that is filled with the process gas, also referred to as a process gas region 36. The deflection of the diaphragm 5 against the upper cavity of gas plate 6 first compresses the process gas and then expels it through a discharge check valve 7. As the oil piston 3 reverses to begin the suction cycle, the diaphragm 5 is drawn downward towards the oil plate 8 while the inlet check valve 9 opens and fills the upper cavity with a fresh charge of process gas at an inlet pressure. The oil piston 3 reaches the end of its stroke before beginning its next stroke, and the compression cycle is repeated.

Embodiments of the present disclosure comprise one or more diaphragm compressor heads 31, each of the one or more diaphragm compressor heads comprising a process gas head support plate 6, a work oil head support plate 8, and a metallic diaphragm 5. The process gas head support plate 6 comprises a process gas inlet operatively connected to the inlet check valve 9 and a process gas outlet operatively connected to the discharge check valve 7. In certain embodiments, the work oil head support plate 8 comprises a piston bore 32 sized to receive the oil piston 3, an inlet 33 operatively connected to one or more inlet check valves 45 (see also FIG. 13), and an outlet 34 operatively connected to one or more relief valves 42. A head cavity 15 is defined between the process gas head support plate 6 and the work oil head support plate 8. The metallic diaphragm 5 is mounted in the head cavity 15 between the process gas head support plate 6 and the work oil head support plate 8, the metallic diaphragm dividing the head cavity into a work oil region 35 and a process gas region 36. In other words, the work oil region 35 is in fluid communication with each of the piston bore 32, where work oil can enter and leave the work oil region 35, the inlet 33, where work oil can enter the work oil region 35, and the outlet 34, where work oil can exit work oil region 35.

In certain embodiments, a hydraulic drive 110 is configured to supply primary work oil to the compressor head 31, the hydraulic drive 110 including a drive cavity 116 extending to the compressor head 31 and in communication with the work oil region 35 via the piston bore 32, and a diaphragm piston 3 mounted in the piston bore 32. The diaphragm piston 3 defines the volume of the work oil region 35 between a top face of the diaphragm piston 3 and a bottom face of the diaphragm 5. Because the diaphragm piston 3 and diaphragm 5 are dynamic, the volume of the work oil region 35 is variable.

The metallic diaphragm 5 is configured to actuate from a first position proximate the work oil head support plate 8 to a second position proximate the process gas head support plate 6 during a discharge cycle to pressurize process gas in the process gas region 36 from an inlet pressure to a discharge pressure, and discharge the pressurized process gas through the discharge check valve 7. During a suction cycle of the compressor head 31, the metallic diaphragm 5 is configured to move from the second position to the first position to fill the process gas region 36 with process gas at the inlet pressure. In embodiments, the diaphragm 5 is a diaphragm set comprising a plurality of diaphragm plates sandwiched together and acting in unison, for example two, three, four, or more diaphragm plates may comprise a diaphragm set. In certain embodiments, the diaphragm plates are made from a metal. In other embodiments, the diaphragm plates are made from different metals. In other embodiments, one or more of the diaphragm plates are not made from metal.

As shown in FIGS. 3-8, in embodiments, the compressor system 100 comprises a first diaphragm compressor head 31 and a second diaphragm compressor head 51. In certain embodiments, the first diaphragm compressor head 31 and the second diaphragm compressor head 51 are driven by a single hydraulic actuator 112. In some embodiments, the hydraulic actuator 112 is operatively coupled to both the first and second diaphragm compressor heads 31, 51, such that the suction cycle of one compressor head aids in initiating the discharge cycle of the other compressor head, which creates a force couple between the compressor heads as discussed further below. In other embodiments, the first and second compressor heads 31, 51 are driven by two separate hydraulic actuators 112. In certain embodiments, the two hydraulic actuators 112 are configured to act in parallel or phase with each other such that the discharge and suction cycles of the first and second compressor heads 31, 51 occur simultaneously or substantially simultaneously.

In some embodiments, the first compressor head 31 and second compressor head 51 are symmetrical, in particular the diaphragm 5 being the same size (e.g., same diameter) and the head cavity 15 being the same volume. In other embodiments, the first compressor head 31 and second compressor head 51 are different sizes resulting in different discharge volumes of the process gas. In either case, the hydraulic drive 110 can be set or adjustably controlled to provide the same process gas discharge pressure or different process gas discharge pressures from the first and second compressor heads 31, 51. In certain embodiments, the process gas discharged from a compressor head (e.g., first compressor head 31) is at a relatively low pressure and may subsequently be fed into another compressor head (either second compressor head 51 or a separate compressor not shown) for further compression.

The process gas may be any gas suitable for pressurization. In embodiments, the process gas is hydrogen. For hydrogen fuel cell vehicles, the required outlet pressure of one or more of the heads 31, 51 may be approximately 10,000-12,000 psi. In embodiments, the target pressure of stored hydrogen is up to about 14,500 psi for a tank for vehicle use to account for pressure losses in, e.g., storage and transfer. The corresponding discharge pressure of the process gas from a compressor is about 15,000 psi.

In some embodiments, a compressor head 31 may be configured for a pressure range of process gas outlet of 200 psi to 15,000 psi. In other embodiments, a compressor head 31 may be configured for a pressure range of 40 psi to 20,000 psi. In still further embodiments, a compressor head 31 may be configured for a pressure range of 300 psi to 15,000 psi. In certain embodiments, the aforementioned compressor heads 31 may be run at pressures below 200 psi, 40 psi, and 300 psi, respectively. In some embodiments, a compressor head 31 can have a compression ratio range of 1:1 to 20:1, or higher.

Hydraulic Drive and Main Stage Valve

In embodiments, the present disclosure is directed to a compressor system 100 comprising a hydraulic drive 110 that is configured to intensify or pressurize work oil and provide the intensified work oil to the compressor head 31. In some embodiments, hydraulic drive 110 comprises a drive housing 114 defining a drive cavity 116, and a hydraulic power unit 118 ("HPU"). In other embodiments, the hydraulic drive 110 includes a plurality of pressure rails 120, and in further embodiments, a piston subassembly 122. In some embodiments, hydraulic drive 110 is configured to provide a variable-pressure supply of work oil to the drive cavity 116 from one or more of: different pressures of work oil in the plurality of pressure rails 120, variable areas of components of the piston subassembly 122 (e.g., a variable-area architecture 180 discussed below), and/or variable control of the piston subassembly.

In certain embodiments, the piston subassembly 122 comprises the diaphragm piston 3 (also referred to as a high-pressure oil piston) mounted at least partially in the actuator housing 114 and extending into the piston bore 32. The diaphragm piston 3 comprises a first diameter 124 and a corresponding first area 125 of the piston head, wherein a first variable volume region 54 comprises the work oil region 35 of the compressor head along with the available volume of the piston bore 32; in other words, the first variable volume region is defined between the diaphragm piston 3 and the diaphragm 5 of the corresponding compressor head 31. The piston subassembly 122 comprises an actuator piston 126 located in the drive cavity 116 and coupled to the diaphragm piston 3, the actuator piston comprising an actuator diameter 128 corresponding to an actuator area 129. The diaphragm piston 3 is coupled mechanically or hydraulically to the actuator piston 126 to move in response to movement of the actuator piston 126. In some embodiments, the diaphragm piston is mechanically rigidly fixed the actuator piston 126 or formed as a unitary one-piece part with the actuator piston.

Figure 8:
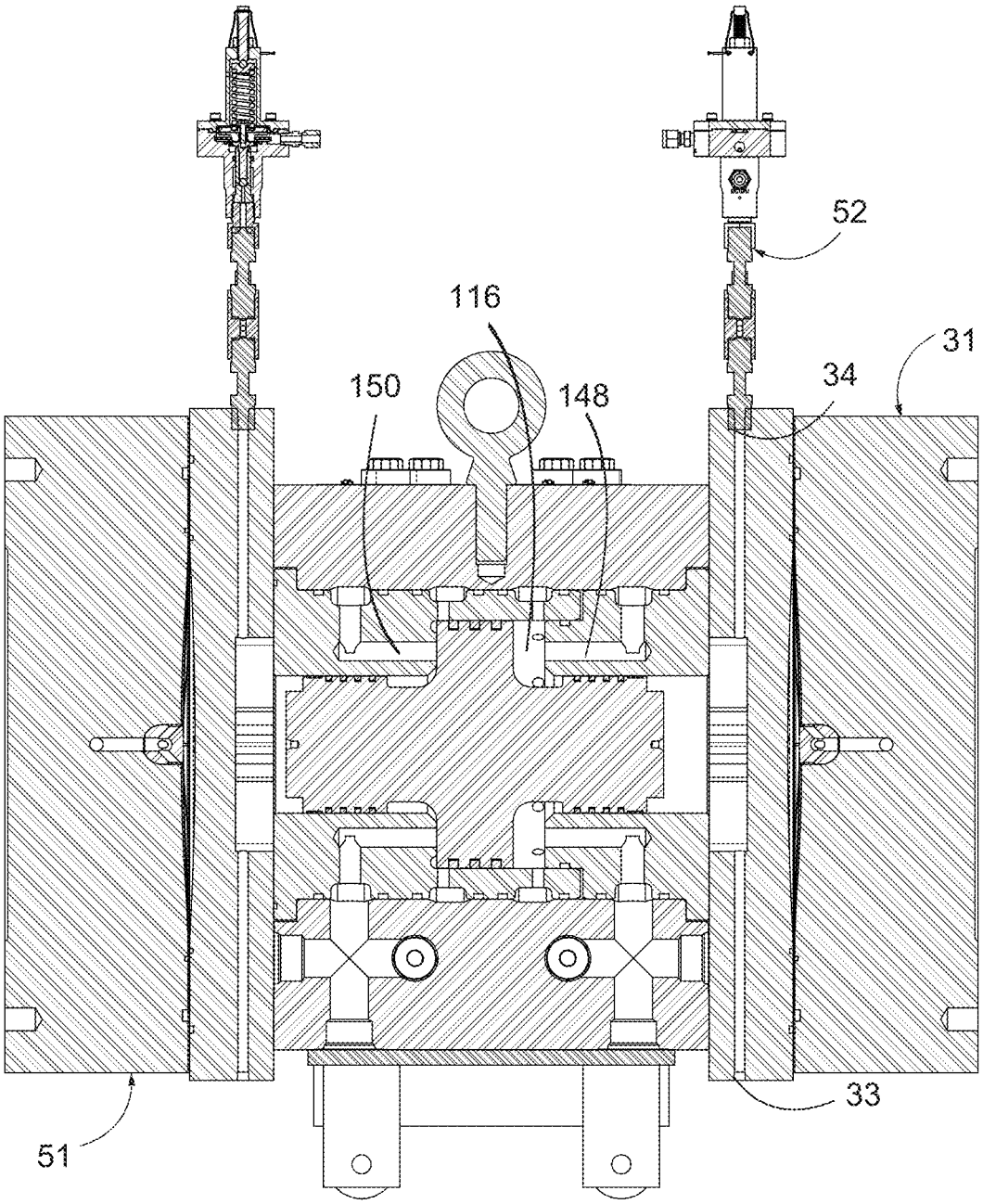
FIG. 8 is side sectional view of the compressor system of FIG. 4.
Figure 9:
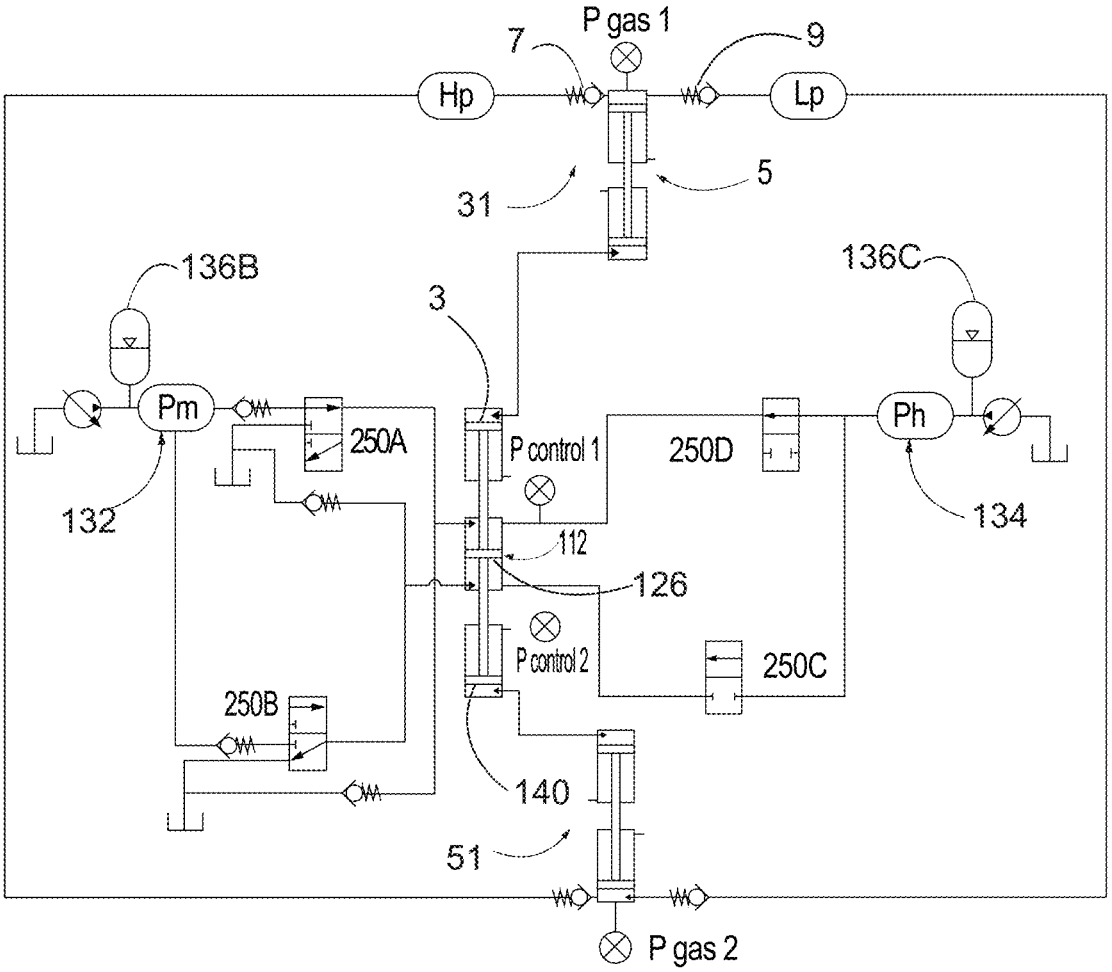
FIG. 9 is a hydraulic circuit diagram of a hydraulically-driven compressor system with two compressor heads in accord with embodiments of the present disclosure.
Figure 10:
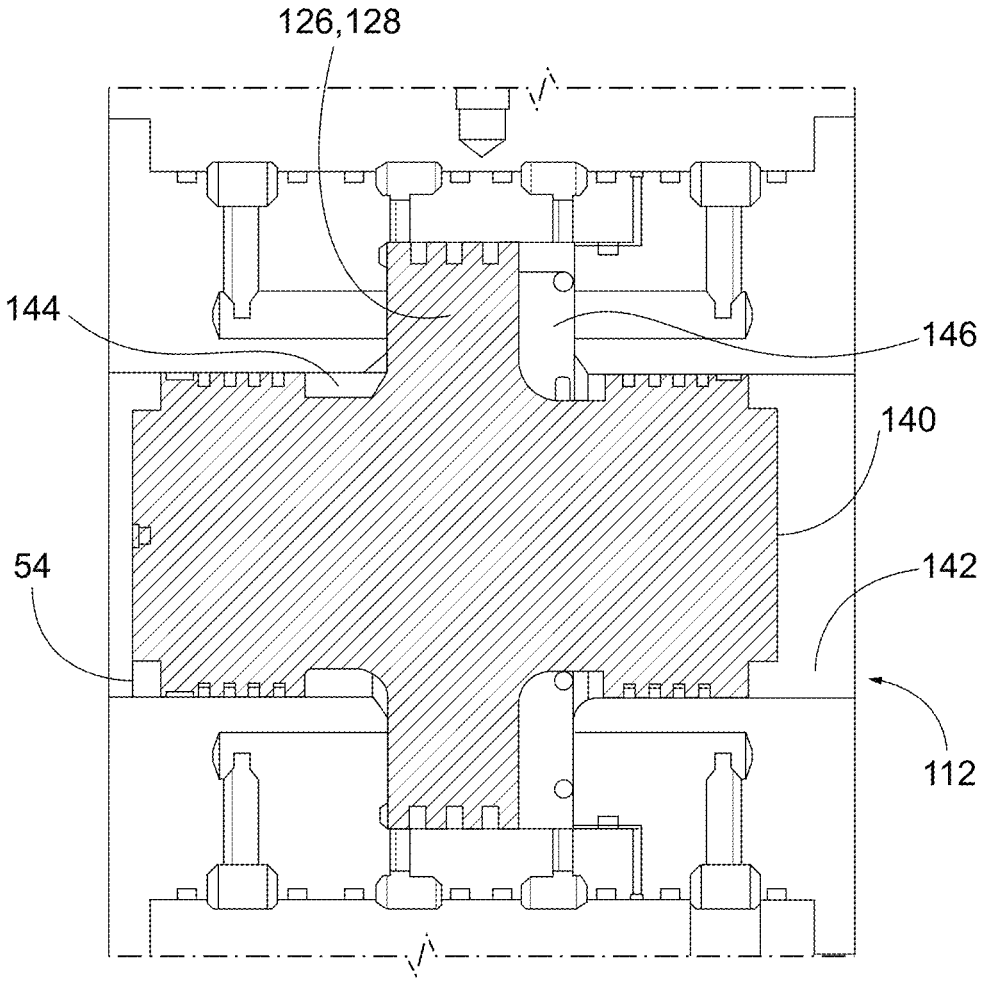
FIG. 10 is a partial top sectional view of a hydraulically-driven compressor system in accord with embodiments of the present disclosure.

FIGS. 7-10 illustrate embodiments of the present disclosure comprising the compressor head 31 and the second compressor head 51. The second compressor head 51 is actuated by a second diaphragm piston 140 defining a second variable volume region 142. In some embodiments, the piston subassembly 122 is mounted in the drive cavity 116 of the actuator housing 114 and a plurality of variable volumes are provided between the piston subassembly 122 and the actuator housing 114. As shown in FIG. 8, a first actuation volume 144 is defined on the side of the actuator piston 126 toward the compressor head 31, and a second actuation volume 146 is defined on the opposite side of the actuator piston and toward the second compressor head 51. Other embodiments may include one, three, or more than 3 variable volumes. Due to movement of the piston subassembly 122, the first and second actuation volumes 144 are variable in volume. The actuator housing 114 also comprises a plurality of ports 147 in communication with the first and second actuation volumes 144, 146. In embodiments, the ports 147 include a first port 148 for the first actuation volume and a second port 150 for the second actuation volume 146. The hydraulic drive 112 is operatively connected to one or more of these actuator volumes 144, 146 through one or more of the respective first and second ports 148, 150. The hydraulic drive 112 is configured to supply work oil or vent work oil as required by the operating conditions of the hydraulic drive. In some embodiments, one or more main stage valves 250 control the flow of work oil to or from one or more of these ports. As shown in FIG. 9, in some embodiments, four main stage valves 250A-D are provided with two for each of the first and second actuator volumes 144, 146, each main stage valve corresponding to a pressure rail of the plurality of pressure rails 120. In this embodiment, for the first actuation volume 144, the main stage valve 250A controls a medium-pressure rail 132 and the main stage valve 250B controls a high-pressure rail 134; for the second actuation volume 146, the main stage valve 250C controls the medium-pressure rail 132 and the main stage valve 250D controls the high-pressure rail 134.

In this particular embodiment, during a discharge cycle of the diaphragm compressor head 31, the variable-pressure supply of work oil is configured to drive the actuator piston 126 toward the compressor head 31, which in turn drives the diaphragm piston 3 toward the corresponding diaphragm 5 of the diaphragm compressor head, intensifying the work oil in the variable volume region 54 to an intensified pressure, and actuating the diaphragm 5 to the second position. In this embodiment, the actuator piston 126 is in axial alignment with diaphragm piston 3, diaphragm 5, and otherwise with the compressor head 31. In other embodiments, at least one of the actuator piston 126 and diaphragm piston 3 are not in axial alignment diaphragm 5, and otherwise with the compressor head 31. In these embodiments, the diaphragm piston 3 intensifies the work oil which is plumbed or routed to the work oil region 35 from at least one non-axial direction relative to the diaphragm 5, and otherwise with the compressor head 31.

Upon completion of the discharge cycle, the suction cycle is initiated. In some embodiments, the suction cycle initiates and the diaphragm piston 3 begins to retract due to one or more of: the intensified work oil in the variable volume region 54 decompressing, a supply of process gas at the inlet pressure being supplied to the drive cavity, and a low-pressure supply of work oil being supplied to the drive cavity 116 above the actuator piston 126 (e.g., from a low-pressure rail 130). In embodiments, the work oil is a compressible fluid. In these embodiments, with the variable volume region 54 under high pressures, the work oil compresses in volume at a molecular level relative to the work oil at a lower pressure. When the hydraulic actuator 112 stops driving the diaphragm piston 3, this compressed work oil may decompress and expand, which can be sufficient to exert a force on, and initiate movement of, the diaphragm piston 3, thereby assisting in pushing the diaphragm piston 3 and actuator piston 126 back to its initial position.

In embodiments, discharge cycle operation begins when the actuator piston 126 is at or near the bottom of its stroke in the drive cavity 116. At this point, inlet-pressure process gas has filled the process gas region 36 of the compressor head 31 and the diaphragm 5 is at the bottom of its stroke proximate to the work oil head support plate 8. When diaphragm motion is desired, a main stage valve 250 (also referred to as a hydraulic control valve) is actuated to allow pressurized work oil flow from the hydraulic power unit 118 and/or one or more of the plurality of pressure rails 120 into the drive cavity 116 behind the actuator piston 126, forcing the actuator piston 126 toward the compressor head 31. As the actuator piston 126 moves, the diaphragm piston 3 also moves and pressurizes the work oil below the diaphragm 5. Once this hydraulic pressure is greater than the pressure of process gas in the process gas region 36, the diaphragm 5 moves upward thereby pressurizing the process gas. Once the process gas pressure within the process gas region 35 reaches a target process gas pressure, the process gas is expelled out of the discharge check valve 7.

In one embodiment, after all or most of the process gas has been forced out of the process gas region 35 by the diaphragm 5, the main stage valve 250 stops providing hydraulic flow to the drive cavity 116 below the actuator piston 126 and the actuator piston 126 stops actuating upwards. The main stage valve 250 is then actuated to connect the drive cavity 116 to a lower pressure rail of the plurality of pressure rails 120 above the actuator piston.

In other embodiments, during the diaphragm compressor 31 suction or intake stroke, the incoming process gas pressurizes the work oil below the diaphragm 5 which applies a force to the diaphragm piston 3, thereby assisting in pushing the actuator piston 126 back to its initial position.

In some embodiments, the discharge cycle initiates and the actuator piston 126 begins to move due to supplying the drive cavity 116 at the bottom side of the actuator piston 126 with one or more of: (1) a supply of high-pressure work oil from a high-pressure rail 134 from the plurality of pressure rails 120 (detailed below), (2) a supply of medium-pressure work oil from a medium-pressure rail 132, (3) a supply of low-pressure work oil from a low-pressure rail 130, and (4) a supply of process gas at the inlet pressure. In embodiments, supplies (3) and/or (4) above function to "assist" with supply (2) or (1), either simultaneously or immediately before supply (2) or (1) begins. In such embodiments, the supplies (3) and/or (4) provide energy savings by utilizing/recapturing energy that is already being spent by the compressor system 100 or by decreasing the amount of energy spent by HPU 118 by decreasing the time spent supplying the medium-pressure rail 132 and/or high-pressure rail 134, and consequently decreasing the volume of work oil that gets pressurized to the medium and high pressures.

As detailed below, in certain embodiments, the piston subassembly 122 may comprise a variable-area architecture 180 providing additional control of the force applied by the diaphragm piston 3 and efficient management of the supply from the HPU 118.

Figure 15A:
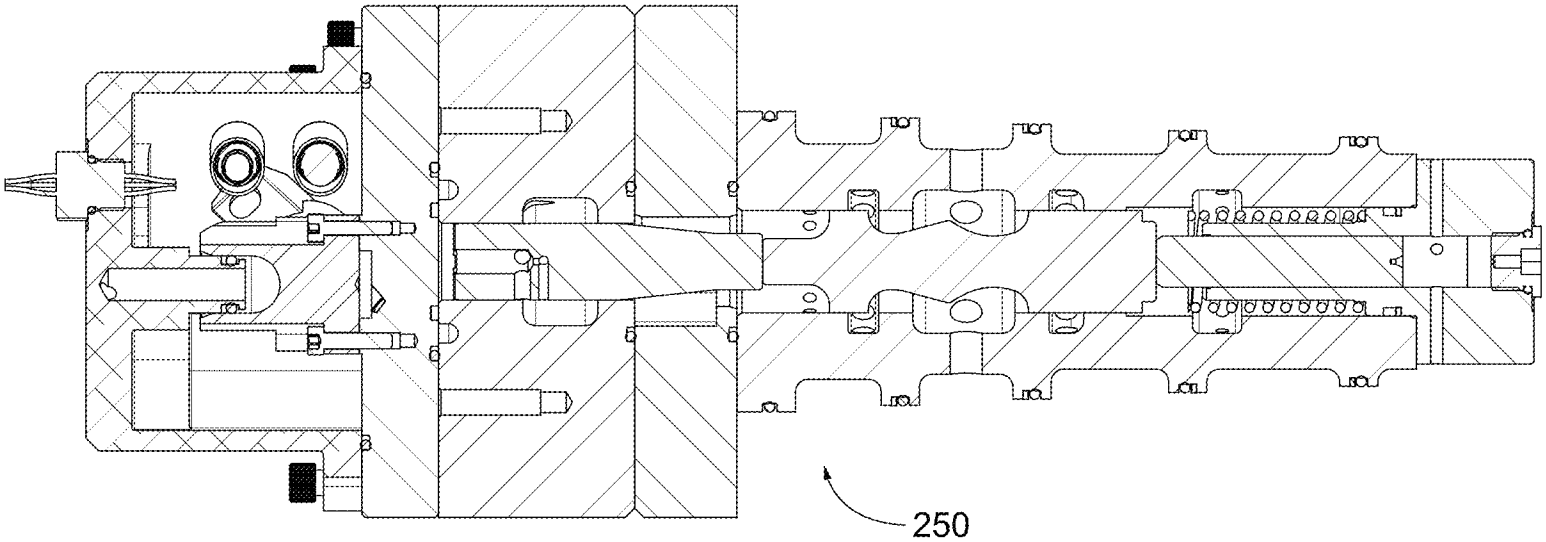
FIGS. 15A-B are a cross-sectional view of operational stages of a main stage valve for hydraulically-driven compressor system in accord with embodiments of the present disclosure.
Figure 15B:
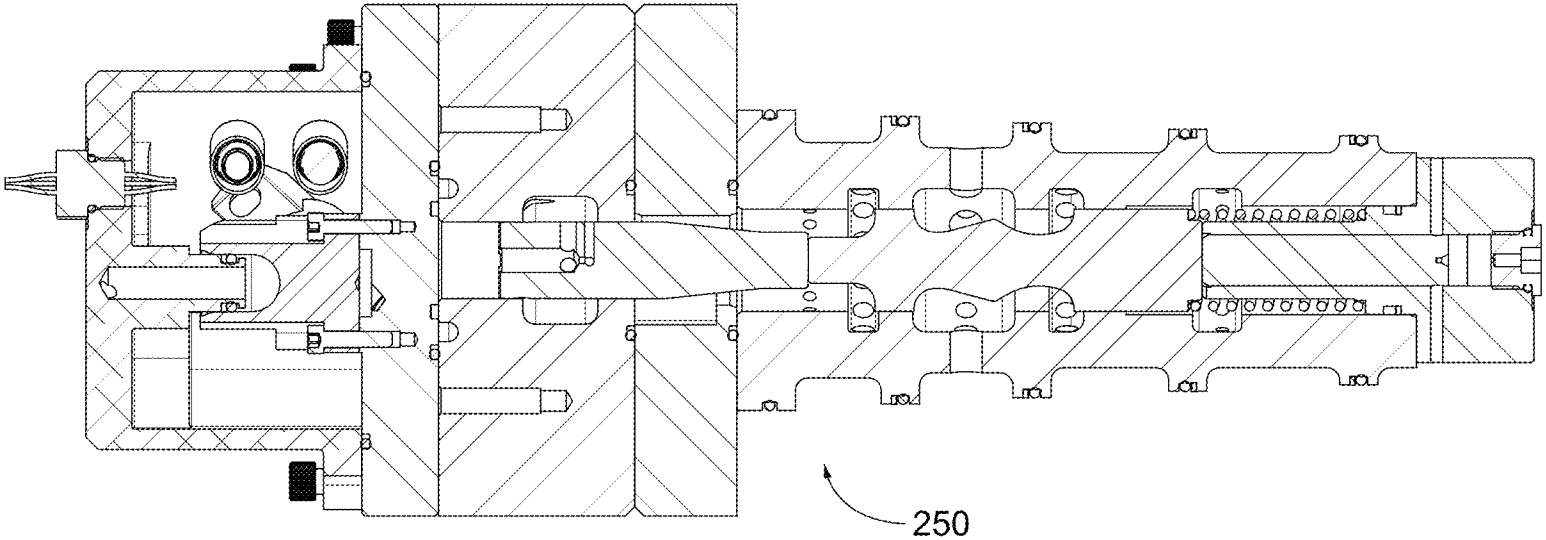

In some embodiments, the main stage valve(s) 250 control the interface of the HPU 118 and plurality of pressure rails 120 with the actuator 112. In other words, the main stage valve(s) control any pressurized hydraulic supply of work oil into the hydraulic drive 110 actuator 112. In embodiments, the main stage valve 250 is an actively-controlled three stage valve, as shown in FIGS. 15A (vent stage) and 15B (supply stage).

In other embodiments, other valve types are employed, including poppet, spool, directional, proportional and servo valves, among others. Different types of valves could be used as main stage valve 250 to operate the system differently. In some embodiments, proportional valves control the flow into the system with a fixed supply pressure. In this way the valve could be used to speed up or slow down the travel of the hydraulic drive actuator to fit a desired profile or to reduce the velocity of the actuator 112 as it nears top dead center or bottom dead center.

In other embodiments, digital or on/off valves allow full flow to be supplied to (or vented from) the main stage valve 250 with a fixed flow area. As these valves open to the pressurized supply of work oil, the maximum flow area is exposed and allows full flow into the main stage valve 250 as dictated by the differential pressure across the valve. These valves are closed to shut off flow to the hydraulic actuator 112 for embodiments as a two-way valve. These valves can also vent the hydraulic actuator 112 for embodiments as a three-way valve. In still other embodiments, a variation of the digital on/off valve has multiple outlet ports that could be opened in series to allow flow to variable areas within the hydraulic drive. In this valve, the internal spool moves only a portion of its travel to open up flow to a single outlet port, then as the spool continues its travel additional outlet ports are opened. Operation of the digital valves can be achieved in several ways. In embodiments, the digital main stage valves 250 are operated with a solenoid to drive the valve. In other embodiments, the digital main stage valves 250 are operated with a set of two-way pilot valves to control the supply of pilot fluid to drive the valve spool. In other embodiments, the digital main stage valves 250 are operated with a single three-way pilot valve to control the supply of pilot fluid to drive the valve spool.

It will be appreciated that in embodiments, the main stage valves 250 can be combinations of one or more of the above valve types.

In embodiments, various control and monitoring architectures may be implemented with the compressor system 100. In some embodiments, a feedback mechanism is configured to detect performance or a state of compressor system 100, which is then communicated to a user or utilized to adjust one or more of the pressure and timing of the variable-pressure supply of work oil. In certain embodiments, the feedback mechanism comprises a sensor configured to detect one or more of the position and velocity of the actuator piston 126. In other embodiments, the feedback mechanism detects one or more of: discharge pressure of process gas, intensified pressure of work oil in the work oil region 35, overpump volume through the outlet 34 of the work support plate, overpump pressure, pressure in one or more of the plurality of pressure rails 120, pressure or flow rate through the main stage valves 250.

Hydraulic Power Unit and Pressure Rails

The hydraulic system pressure(s) provided by the hydraulic power unit 118 ("HPU") in some embodiments ranges from 0-5000 psi, but in other embodiments a higher hydraulic pressure is implemented. The HPU 118 in embodiments comprises a single pump/motor, many small pump/motor systems, or fewer larger pump/motor systems, or combinations thereof, as based on operational requirements. In embodiments, the hydraulic drive system 100 comprises actively-controlled pressure-compensated pumps or the like in order to actively control hydraulic pressure throughout operating modes. This active control enables the hydraulic drive system 100 to operate efficiently by minimizing energy expenditure to meet system requirements. The HPU 118 is configured to provide work oil at a pressure to the drive cavity 116, and in some embodiments, this pressure is intensified, e.g., by increasing the supply area relative to the piston area.

For some embodiments, in order to minimize hydraulic energy consumption, a variable pressure architecture of the hydraulic system 100 provides a variable-pressure supply of work oil to provide step or analog changes in the applied pressure to any actuator piston 126. Because the force acting on the diaphragm piston 3 by the process gas changes as the process gas is compressed (i.e., process gas in the process gas region 36 compresses due to movement of the diaphragm 5), the variable pressure architecture allows the hydraulic drive system 100 to supply less than the maximum required pressure through some portion of the stroke where maximum pressure is not required. which would be significantly more energy input than required to move the piston. In other words, the pressure required to move the actuator piston 126 at the end of its stroke, when the process gas is at its highest pressure, is not required at earlier parts of the actuator piston's 126 stroke, and applying maximum pressure along the entire stroke of actuator piston 126 applies more pressure than necessary, therefore wasting energy. In embodiments, the hydraulic drive system 100 applies less than maximum pressure to the actuator piston 126 for a substantial portion of each stroke.

In embodiments, for different operating modes, the hydraulic drive 110 may supply work oil supplied at multiple different set pressures (also referred to as pressure rails). In some embodiments, this is achieved by using the entire HPU 118 to pump to a high set pressure, then throttling the work oil to a lower pressure in a rail via pressure regulators. In other embodiments, the HPU 118 uses discrete pump/motor sets producing discrete pressures that supply some or all of the plurality of pressure rails 120 individually in order to eliminate throttling losses. Embodiments applicable to the present disclosure implement the plurality of pressure rails 120 as a combination of throttled work oil and discrete pump/motor sets. Moreover, in certain embodiments, either one or both of the above approaches is used to charge one or more accumulators that are included in one or more of the plurality of pressure rails 120.

In embodiments, the set points for the pressure rails is responsive to sensed conditions of the hydraulic actuator 112, increasing pressure as the force demand increases. In some embodiments that are applicable, for example, at high-frequency cycling, the pressure for one or more of the plurality of pressure rails 120 is set at a fixed pressure calculated to provide a predetermined outlet process gas pressure. This process gas pressure will dictate the maximum required hydraulic pressure based on the known exposed hydraulic area, e.g. of the hydraulic actuator.

In embodiments of the variable pressure architecture, a low-pressure rail 130 is implemented to provide a "backfill" or "assist" hydraulic supply to the hydraulic system 100 when a higher pressure is not needed (e.g., when ambient-pressure work oil or other relatively low-pressure work oil is sufficient). In certain embodiments, as the hydraulic actuator starts to move from the end of its stroke, the force imposed by the intake stroke process gas on the diaphragm 5 imposes an aiding force on the diaphragm piston 3 and consequently on the actuator 112. In some embodiments, this force may be enough to move the actuator 112, or initiate movement of the actuator 112, with minimal pressure from the HPU 118 or without the addition of hydraulic pressure to available work oil. The drive cavity 116, however, will still need a supply of work oil to backfill in one of the actuation volumes 144, 146 to allow the actuator 112 to move in the opposite direction. However, in certain embodiments, to supply the drive cavity 112 with throttled high-pressure fluid may be energy inefficient, and may provide more pressure than necessary at this stage of the stroke, whereas a low-pressure supply rail 130 can provide this low-pressure work oil with minimal or no throttling losses or energy spent pressurizing and throttling. The low-pressure rail 130 can be supplied several ways. In embodiments, the low-pressure rail 130 comprises relatively low-pressure work oil from one or more of the following: unpressurized work oil from the HPU 118, an oil reservoir 38 of the AOIS 30 (discussed below), vented work oil from the drive cavity 116 in a previous cycle (e.g., intensified work oil vented via a valve and stored in a hydraulic accumulator 136D as discussed below), work oil in the variable volume region 54, process gas at the inlet pressure, or other sources in the compressor system 100.

In certain embodiments, the plurality of pressure rails 120 comprises a medium-pressure rail 132 comprising work oil pressurized by the HPU 118 either by a throttled supply of higher pressure work oil or by a direct supply from one or more pumps/motors of the HPU. In some embodiments, the plurality of pressure rails 120 comprises a high-pressure rail 134 comprising high-pressure work oil pressurized by the HPU 118. It will be appreciated that any of the low-pressure rail 130, medium-pressure rail 132, and high-pressure rail 134 may be implemented as multiple pressure rails at different set pressures. In other words, the plurality of pressure rails 120 in embodiments comprises one, two, three, or more low-pressure rails 130 at different low pressures; one, two, three, or more medium-pressure rails 132 at different medium pressures; and one, two, three, or more high-pressure rails 134 at different high pressures. The additional rails of the plurality of pressure rails 130 allow for finer tuning and control of the compressor system 100, for example in controlling the increasing pressure supplied to the actuator piston 126 during the discharge cycle. In certain embodiments more than ten pressure rails 120 may be used. In other embodiments, an HPU may supply an infinitely variable set of pressure rails 120.

As discussed above, in embodiments the hydraulic drive system 100 is configured to control the variable-pressure supply of work oil by supplying work oil from the high-pressure rail 134 after work oil has been supplied from the low-pressure rail 130 and/or the medium-pressure rail 132. In certain embodiments, the hydraulic drive system 110 is configured to control the variable-pressure supply of work oil by sequentially providing work oil to the drive cavity 116 from the low-pressure rail 130, the medium-pressure rail 132, and the high-pressure rail 134. In embodiments with low pressure operating conditions or requirements, it may be sufficient to provide the work oil to the drive cavity 116 from the low-pressure rail 130 and the medium-pressure rail 132, only. In other words, in certain embodiments, a high pressure rail 134 may be present but not used during low pressure operating conditions or requirements. This may be useful, for example, in cases where a compressor head 31 capable of compressing a process gas to a high pressure is used to compress process gas to a relatively lower pressure.

In some embodiments, the plurality of pressure rails 120 are each operatively connected to the drive cavity 116 and may be fed on one or both sides of the actuator piston 126. In embodiments, the hydraulic drive 110 comprises a passive first valve 131 configured to supply work oil from the low-pressure rail 130 to the drive cavity 116 and an active three-stage second valve 133 configured to supply work oil from the medium-pressure rail 132 to the drive cavity. Certain embodiments further comprise an active three-stage third valve 135 configured to supply work oil from the high-pressure pressure rail 134 to the drive cavity 116.

In certain embodiments, each of the active three-stage second valve 133 and the active three-stage third valve 135 is configured to adjust from a supply stage to a return stage, the return stage permitting an outflow of intensified work oil from the drive cavity 116 during the suction cycle of the compressor head 31. In embodiments, a hydraulic accumulator 136D receives the outflow of intensified work oil from the drive cavity 116. The hydraulic accumulator 136D in some embodiments serves as the low-pressure rail 130, medium-pressure rail 132 or the high-pressure rail 134.

Accordingly, the low-pressure rail 130 can be supplied several ways. Fluid flow from the high-pressure supply can be regulated down to the desired pressure, but this method is no more energy efficient than throttling high pressure fluid directly into the actuator cavity. A separate hydraulic power supply that only pumps the fluid up to the desired low-pressure rail pressure can be used. An alternate method for supplying fluid to the low-pressure rail is to capture the fluid that is being vented from the hydraulic drive pistons at the end of its stroke. This fluid can be diverted to a hydraulic reservoir and stored at a pressure lower than the original pressure rail source, but higher than ambient or source pressure for the HPU.

Supplying flow from the low-pressure rail 130 into the hydraulic actuator 112 can be achieved several ways. In some embodiments, the fluid can be supplied through a hydraulic valve (in place of the passive first valve 131) that opens to allow flow into the actuator 112 then closes when high pressure fluid is required. In other embodiments, the flow can be supplied through a check valve, such as the passive first valve 131, which opens as the hydraulic actuator 112 starts to move due to the force imposed by intake of process gas during a suction cycle. Since this is a passive valve, it does not need to be actuated when high pressure fluid is supplied to the actuator cavity as the high-pressure fluid will force the valve closed. Alternately, a three-way valve can be used to supply high-pressure fluid to the hydraulic actuator 112 and vent it when desired. The vent of this rail can be connected to the low-pressure rail 130 as outlined above. In this scenario, fluid from the low-pressure rail 130 can back flow through the passive first valve 131 into the hydraulic actuator 112 as the actuator starts to move. In certain embodiments, if this valve has an underlapped spool, there may be no interruption in flow as the valve moves to supply high pressure fluid.

In certain embodiments, a medium pressure rail 132 is set to a pressure approximately 50% of the high pressure rail 134. In other embodiments, a medium pressure rail 132 is set to a pressure approximately 40% to 60% of the high pressure rail 134. In some embodiments, the high pressure rail 134 is set at a pressure of approximately 5,000 psi, the medium pressure rail 132 is set to from 2,500 psi to 3,000 psi, and the low pressure rail 130 is set to approximately 500 psi. In other embodiments, high pressure rail 134 is set to a pressure selected from 3,000 psi, 5,000 psi, and 7,500 psi. In some embodiments, at least one of the high pressure rail 134 and medium pressure rail 32 are controlled by the HPU to be variable from the maximum pressure for each respective rail. In other embodiments, at least one of the high pressure rail 134 and medium pressure rails 132 are controlled by the HPU to be variable in a range from 0% to 100% of the maximum pressure for each respective rail. In further embodiments, at least one of the high pressure rail 134 and medium pressure rails 132 are controlled by the HPU to be variable in a range from 50% to 100% of the maximum pressure for each respective rail. In certain embodiments, high pressure rail 134 has a variable pressure from about 0 psi to about 5,000 psi.

In certain embodiments, the HPU includes one motor and pump per pressure rail 120. In some embodiments, the low pressure rail 130 does not include a motor and pump. In other embodiments, the HPU includes more than one motor and pump per pressure rail 120.

In certain embodiments, compressor 1 may include two stages, for example a low pressure stage and a high pressure stage. In some embodiments, these stages include first compressor head 31 and second compressor head 51, respectively. These embodiments may include a high pressure rail 134 for high pressure stage, and a high pressure rail 134 for the low pressure stage that is set at a lower pressure, respectively. Similarly, other embodiments may include a medium pressure rail 132 for high pressure stage, and a medium pressure rail 132 for the low pressure stage that is set at a lower pressure, respectively. These embodiments may also include one or more low pressure stages 130. In some embodiments, the number of rails 120 is represented by the equation $2n+1$, where n is the number of stages operating at a unique operating pressure. In the example above, this would include $2(2)+1=5$ stages, however, multiple such two-stage compressors with the same operating conditions at the low pressure stage and high pressure stage could operate with those same five pressure rails 120.

Some embodiments use only a single pressure rail 120, with or without a low pressure rail 130. In these embodiments, the compressor 1 may include two stages, for example a low pressure stage and a high pressure stage. In some embodiments, these stages include first compressor head 31 and second compressor head 51, respectively. In these embodiments, the area of the respective variable volumes of the piston subassembly 122 and the actuator housing 114 may include a first actuation volume 144 is defined on the side of the actuator piston 126 toward the compressor head 31, and a second actuation volume 146 is defined on the opposite side of the actuator piston and toward the second compressor head 51. In these embodiments, the area of the second actuation volume is greater than the area of the first actuation volume, resulting in the actuator actuating with a greater force in the second compressor head 51 than in the first compressor head 31, while using the same pressure rail 120. Other embodiments may include one, three, or more than 3 variable volumes defined on the side of the actuator piston 126 toward either compressor head 31, 51.

Figure 14:
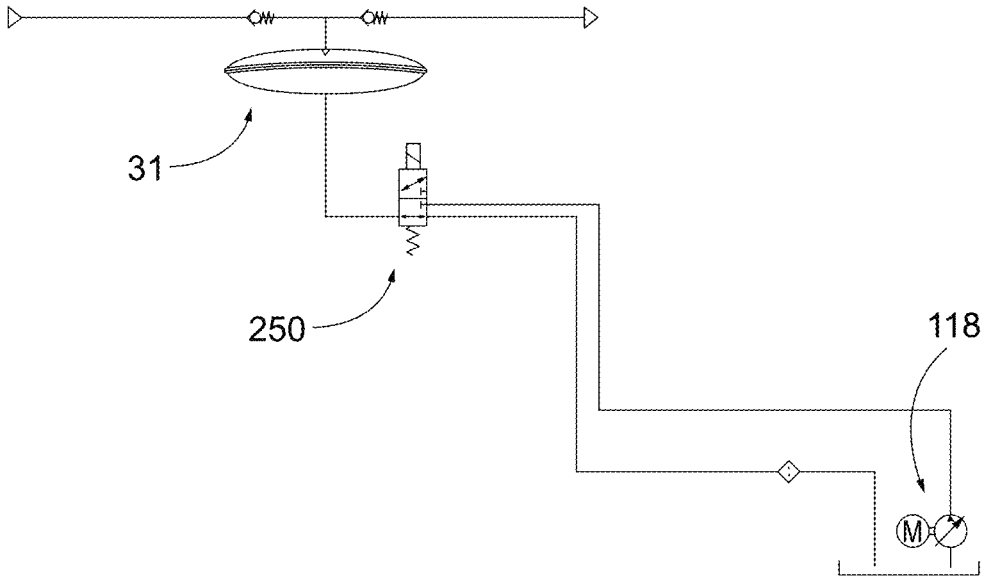
FIG. 14 is a schematic view of a hydraulically-driven compressor system with direct hydraulic drive in accord with embodiments of the present disclosure.

In an embodiment shown in FIG. 14, the HPU 118 is configured to act directly on the diaphragm 5 while omitting hydraulic actuator 112 and the piston subassembly 122. The main stage valve 250 is operatively connected to the HPU 118 to control the supply of work oil directly to the diaphragm 5. In embodiments, any one or more of the plurality of pressure rails 120 is implemented and controlled by one or more main stage valves 250.

Force Bias

Embodiments of the present disclosure employ a force biased architecture 160 shown in FIGS. 11A-D, which is similar to the fundamental hydraulic drive system 100 of FIG. 1 while also providing an energy recovery mechanism during drive cycles. Embodiments of the force biased architecture 160 comprises a tandem hydraulic drive 161 that may or may not act as a hydraulic intensifier, which is actuated to provide high pressure work oil below the diaphragm 5 to actuate the diaphragm compressor 31. In embodiments, the force-bias architecture or mechanism is configured to provide stored energy to one or more of first and second actuator pistons 166, 170 to initiate the suction cycle of the compressor. The energy recovery mechanism applies a preload or force bias to the tandem hydraulic drive 161 reducing the force and energy requirements to initially move a tandem actuator 162. For any energy recovery mechanism(s) providing this force bias, the magnitude of the applied force bias force may be preset or actively adjusted based on operational requirements.

As shown in FIGS. 11A-D, in embodiments the tandem hydraulic drive 161 comprises a first chamber 164 with a respective first actuator piston 166 and a second chamber 168 with a respective second actuator piston 170, the first and second actuator pistons 166, 170 being rigidly connected by a common shaft 172. At least one of the first and second chambers 164, 168 is operatively connected to the HPU 118 and/or one or more of the plurality of pressure rails 120. Accordingly, whereas in FIG. 1 the drive cavity 116 is a single chamber for a single actuator piston 126, in embodiments of the force bias architecture 160, the drive cavity comprises the first and second chambers 164, 168 for the tandem actuator 162. In some embodiments, the actuator piston or the individual first and second actuator pistons 166, 170 incorporates aspects of the variable-area architecture 180 discussed above.

With reference to FIGS. 11A-D, an embodiment of the discharge and suction cycles of a compressor head 31 is shown with force bias provided hydraulically by an accumulator 136D. For a discharge stroke of the compressor head 31 shown in FIG. 11A, operation begins when the tandem actuator 162 is at or near the bottom of its stroke. At this point, lower pressure process gas fills the process gas region 36 and the diaphragm 5 is at the bottom of its stroke and proximate to the work oil head support plate 8.

Figure 11A:
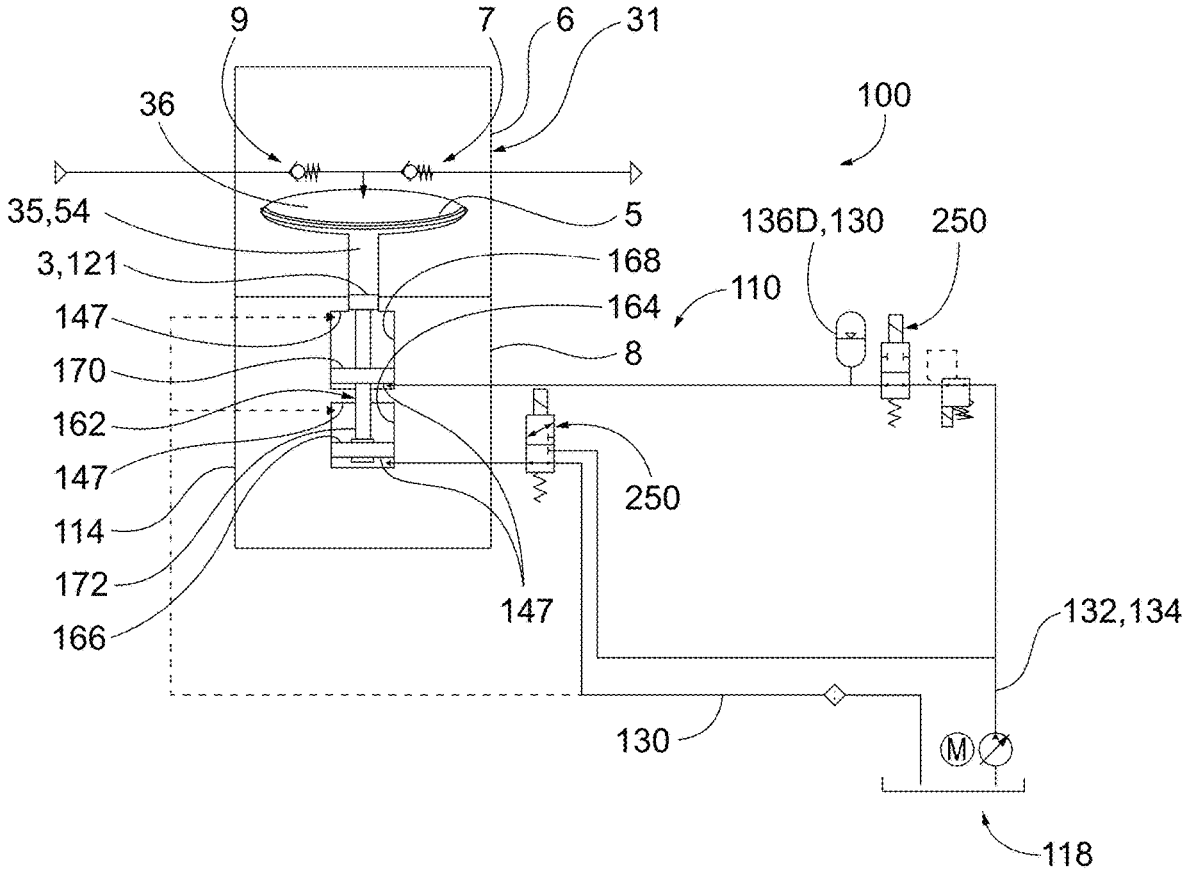
FIGS. 11A-D are schematic views of a hydraulically-driven compressor system with force bias in accord with embodiments of the present disclosure
Figure 11B:
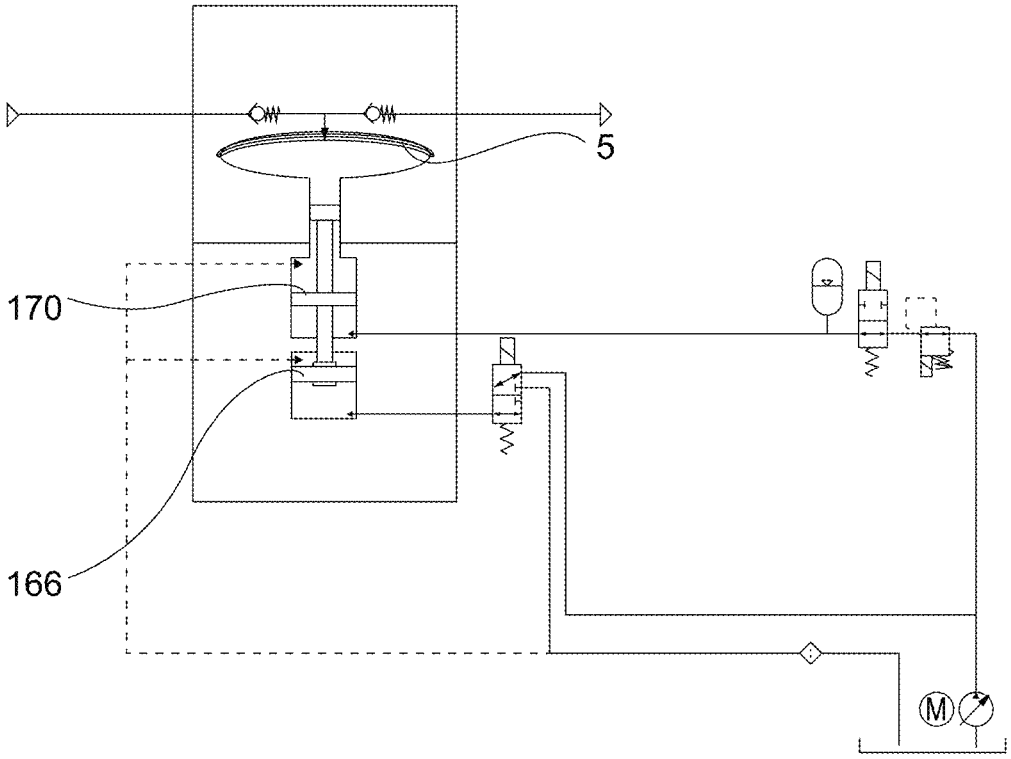

In FIG. 11B, when diaphragm motion is desired, the main stage valve 250 is actuated to allow high pressure work oil flow into the first chamber 164 against a rear side of the first actuator piston 166 forcing the tandem actuator 162 upward. As the hydraulic drive tandem cylinder moves up, the high-pressure oil piston pressurizes the work oil below the diaphragms. Since this hydraulic pressure is greater than the gas chamber pressure, the diaphragms move upwards thereby pressurizing the process gas within the gas chamber. Once the gas pressure within the gas chamber reaches a target process gas pressure, the process gas is expelled out of the outlet gas check valve 7. After all or most of the process gas has been discharged, the main stage valve 250 stops providing flow to the bottom side of the actuator piston 162 and the tandem hydraulic drive 161 stops actuating upwards.

Subsequently, for a suction cycle of the compressor head 31 shown in FIG. 11C, the main stage valve 250 is actuated to connect the first chamber 164 to a supply of work oil(e.g., a low-pressure rail 130) to backfill above the first actuator piston 166. During the diaphragms compressor's 31 intake stroke, the process gas pressurizes the work oil below the diaphragm 5 which applies a force to the high-pressure oil piston 3 thereby assisting in pushing the tandem actuator 162 back to its initial position.

However, when the tandem actuator 162 is moving down, fluid is pressurized by the second actuator piston 170 and this energy is stored in an energy storage mechanism. In the illustrated embodiment of FIGS. 11A-D, the hydraulic accumulator 136D stores energy via pressurized fluid. In this manner, the hydraulic accumulator 136D is configured to store intensified work oil from a previous cycle of the tandem hydraulic drive 161.

Figure 11C:
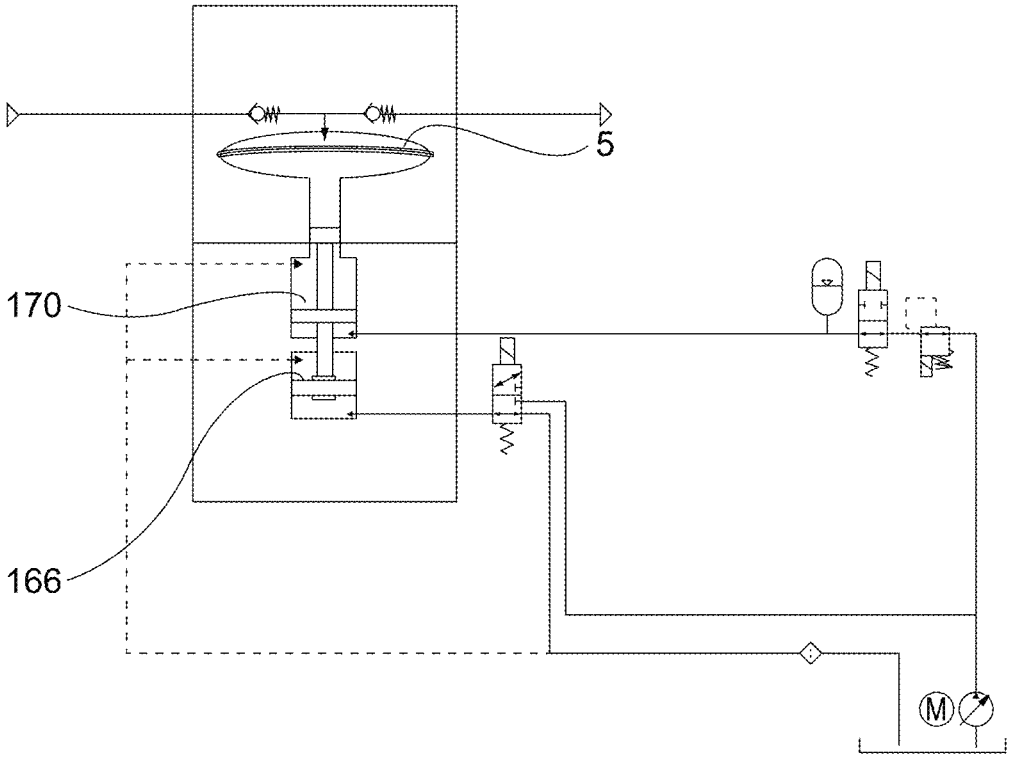

This accumulator 136D or other energy storage mechanism applies a preload or force bias to the tandem actuator 162 (e.g., force bias in the upward direction in the perspective of FIG. 11C), reducing the additional force requirements to initiate movement of the tandem actuator and to actuate the diaphragm compressor 31.

Figure 11D:
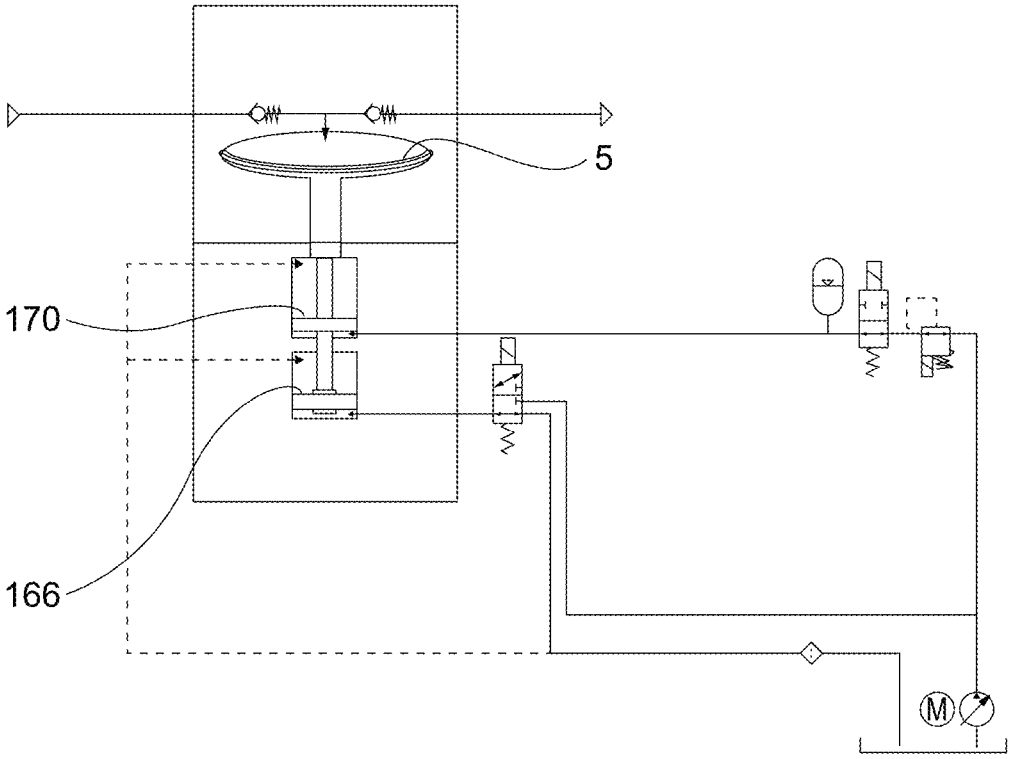

As shown in FIG. 11D, the process gas then assists in forcing the first actuator piston 166 back to its initial position by pressing against the diaphragm 5. Once the tandem actuator 162 is at or near to bottom of its stroke, the constant force bias of the hydraulic accumulator 136D acts on the second actuator piston 170.

Accordingly, the force biased architecture 160 in some embodiments incorporates the hydraulic accumulator 136D to store energy in the form of pressurized fluid. In such embodiments, the second chamber 168 is added to the actuator housing 114 and operative with the common drive shaft 172. The hydraulic accumulator 136D is connected to the second chamber 168. As the diaphragm piston 3 is driven back from the compressor 31 by intake stroke gas, fluid is pumped into the hydraulic accumulator 136D and stored for recovery. In other embodiments, the first chamber 164 at the rear of the tandem actuator 162 functions as the drive cavity and the second chamber 168 for energy storage. In still other embodiments, the hydraulic accumulator 136D is operatively connected to both the first and second chambers 164, 168 to selectively apply a force bias to either or both chamber to provide the stored energy to one or more of the first and second actuator pistons 166, 170 to initiate the discharge cycle.

As noted, in other embodiments, the energy storage mechanism may be a mechanism other than a hydraulic accumulator that is arranged to constantly apply a force in the direction of the discharge stroke for a piston; in embodiments the energy storage mechanism can be a spring, a weight affected by gravity, or the like.

Force Coupling

In certain embodiments, another energy recovery mechanism can be provided through a force couple architecture 190 shown in FIGS. 12A-D. An embodiment of this architecture is also shown in FIGS. 7-10. Some embodiments of this architecture comprise a pair of opposing diaphragm compressors heads 1, 2 driven by an actuator piston 126 that is a double acting double rod, which may or may not act as a hydraulic intensifier, which is actuated to provide high pressure work oil to actuate the diaphragm compressors. In certain embodiments, the force coupled design is similar to the base hydraulic drive concept (e.g., FIG. 1) and rigidly connects the two diaphragm pistons 3, 140 with a common shaft 192. The two pressurized actuation volumes 144, 146 are alternately fed pressurized fluid and vented to drive the shaft assembly back and forth towards either compressor 1, 2. The force couple architecture 190 imposes a force couple to the actuator 112 reducing the additional force and energy requirements to move the hydraulic drive coupled cylinder to actuate the diaphragm. Since these diaphragms 5 oppose each other and are out of phase, the force imposed by the intake stroke process gas on one diaphragm imposes an aiding force during the opposing diaphragm's compression stroke.

Figure 12A:
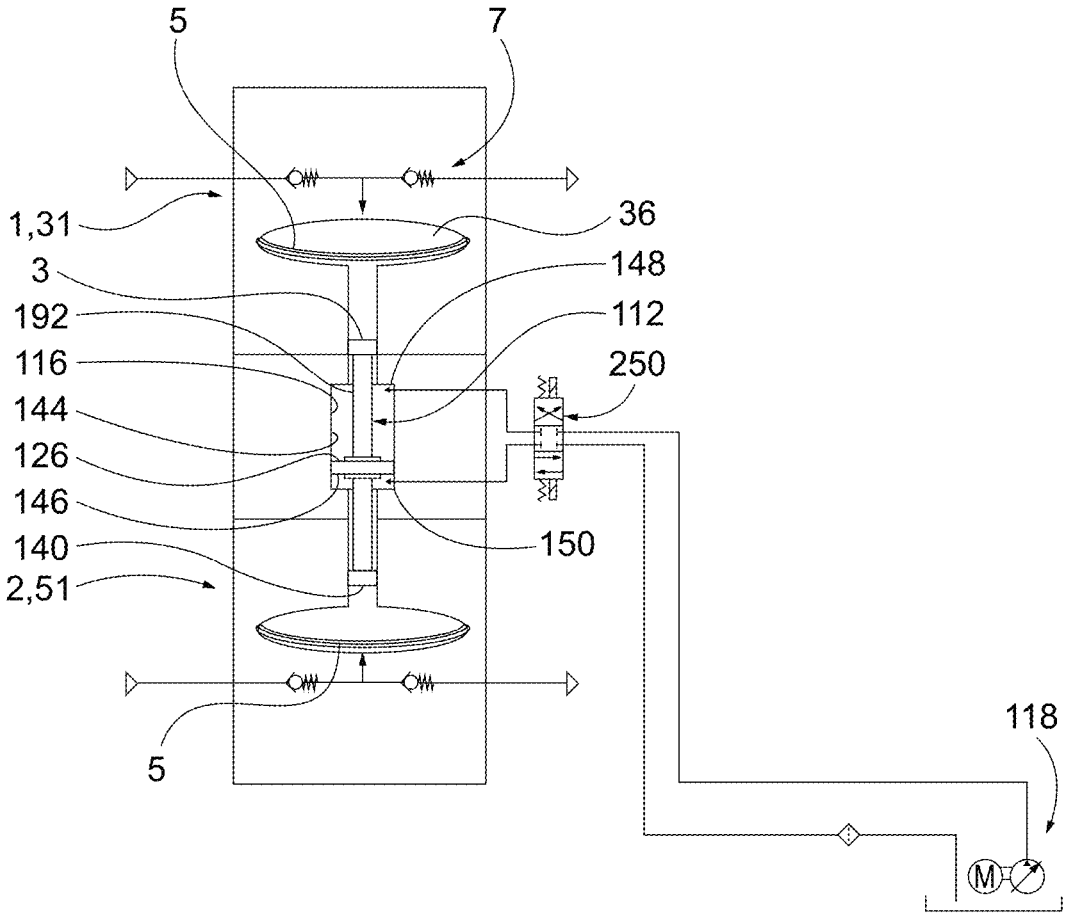
FIGS. 12A-E are schematic views of a hydraulically-driven compressor system with force coupling in accord with embodiments of the present disclosure

With reference to FIGS. 12A-D, an embodiment of the discharge and suction cycles of a compressor system with two opposed compressor heads 31, 51 with force bias is shown. In FIG. 12A, operation begins when the actuator piston 126 is at or near either end of its stroke. At this point, process gas fills a single diaphragm compressor head 31 and the opposing second compressor head 51 is fully evacuated of process gas.

Figure 12B:
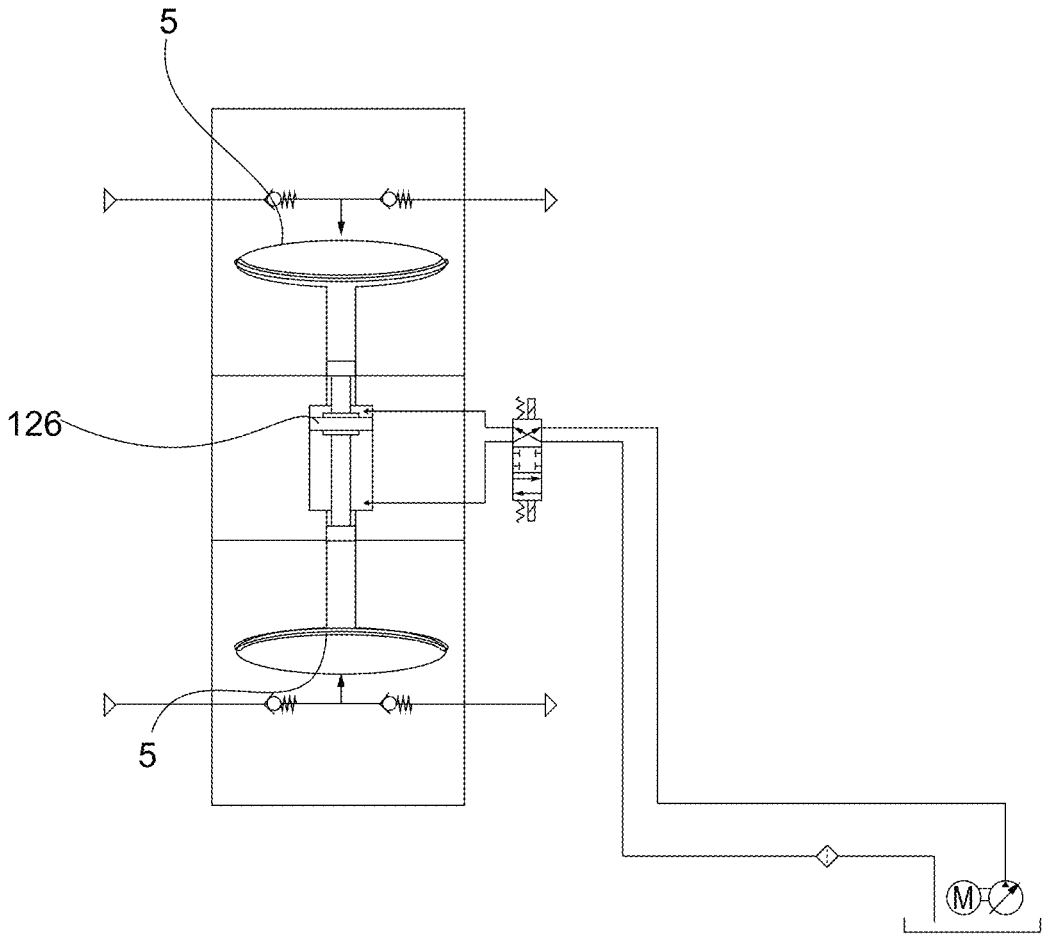

In FIG. 12B, when diaphragm motion is desired, the main stage valve 250 is actuated to allow pressurized work oil flow into one side of the actuator piston 126 forcing the hydraulic drive coupled cylinder up towards the compressor head 31 that is filled with process gas. As the actuator piston 126 moves, the high-pressure oil piston 3 pressurizes the work oil below the diaphragm 5. Since this hydraulic pressure is greater than the pressure of process gas, the diaphragm 5 moves upwards thereby pressurizing the process gas. Once the process gas pressure reaches a target process gas pressure, the process gas is expelled out of the outlet gas check valve 7. After all, or most of the process gas has been forced out of the process gas region 36, the main stage valve 250 stops providing hydraulic flow and the actuator piston 126 stops actuating.

Figure 12C:
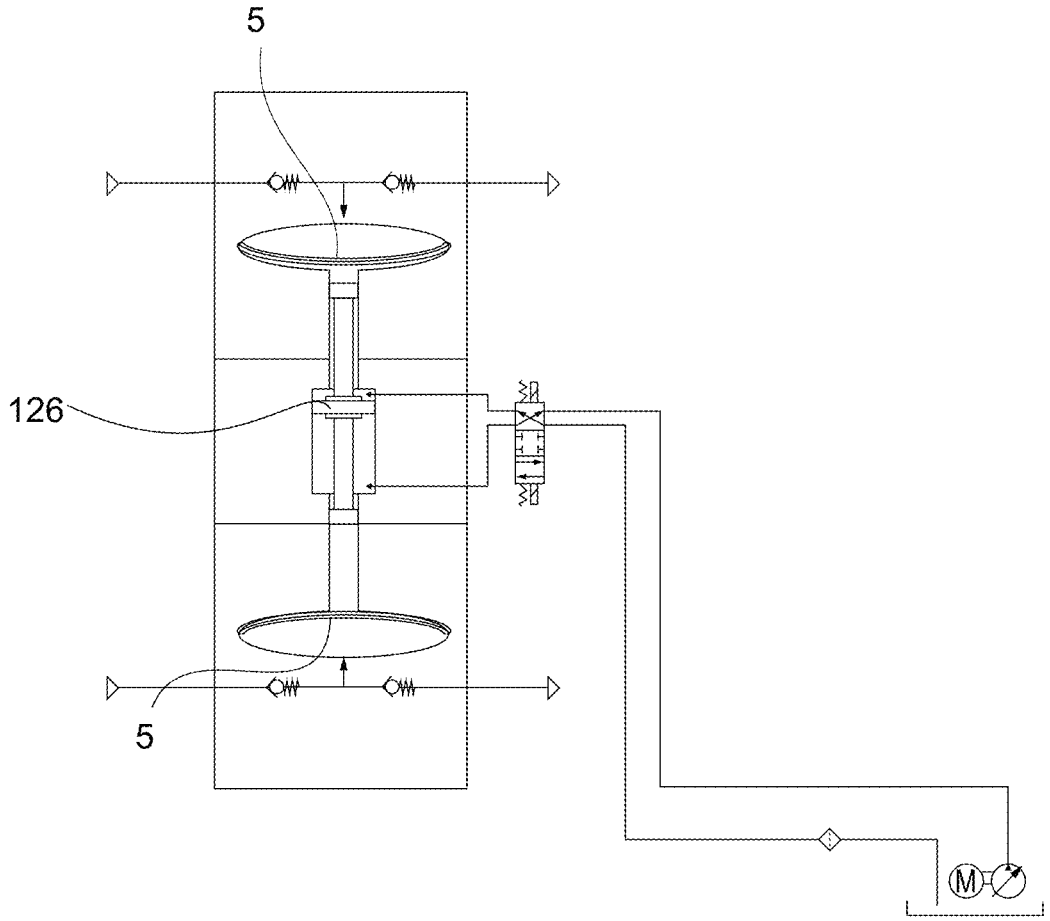

In FIG. 12C, when diaphragm motion is desired in the opposing direction, the main stage valve 250 is actuated to provide pressure to the opposing side of the actuator piston 126, thereby forcing the actuator piston in the opposite direction compressing the gas in the second compressor 2. As the hydraulic drive 112 pressurizes the gas within the second compressor 2, the compressor 1 is undergoing its intake stroke where the process gas pressurizes the work oil below the diaphragm 5, which applies a force to the diaphragm piston 3 within the compressor 1 thereby providing an aiding force during the opposing diaphragm 5 compression stroke. This aiding force reduces the required force from the HPU 118 to compress gas in the second compressor 2.

Figure 12D:
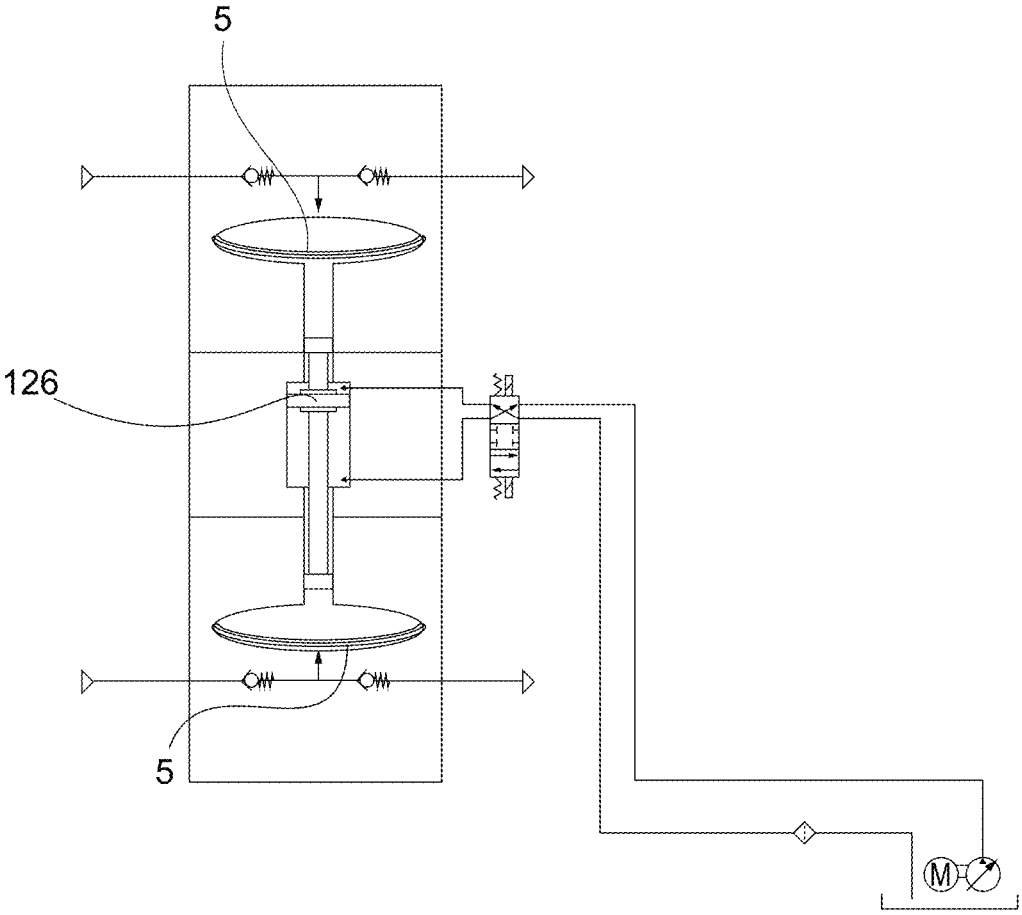
Figure 12E:
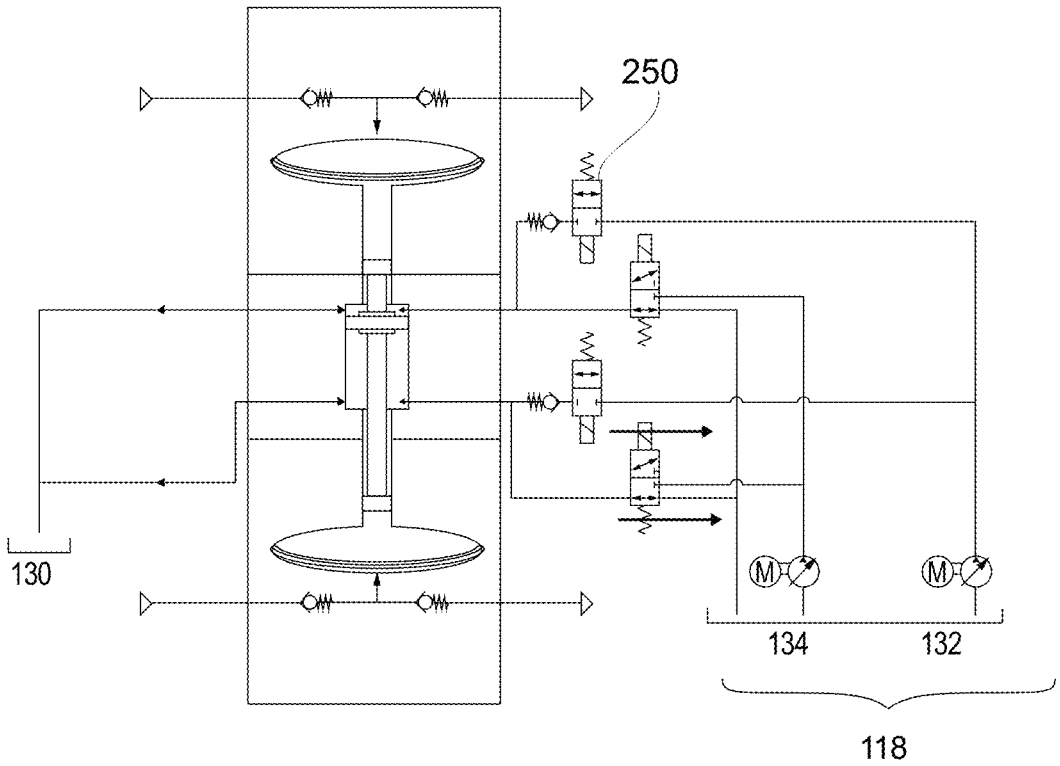

Turning to FIG. 12D, at this point, process gas fills a single compressor head's 31 process gas region 36 and the opposing second compressor head 51 process gas region 36 is fully evacuated of process gas. In this arrangement, the compressor 1 is filled with process gas and the second compressor 2 is fully evacuated of gas.

Piston Architecture

In some embodiments, the piston subassembly 122 can be adjustably tuned as a variable area architecture 180 by providing plurality of intermediate pistons 182 or a nesting drive 184 and in such embodiments, the effective diameter applied to the drive piston 3 is the sum of the areas of the plurality of diaphragm pistons 182.

In order to minimize hydraulic energy consumption, in embodiments a variable area architecture 180 is implemented to provide step or analog changes in the exposed effective area to any hydraulic drive cylinder of the piston subassembly 122 (e.g., actuator piston 126 or diaphragm piston 3). Because the force acting against the diaphragm piston 3 by the process gas changes as the process gas within the process gas region 36 is being compressed, applying a variable area architecture allows each architecture to expose only a required effective area to actuate the high pressure oil piston rather than maintaining a constant effective area and corresponding maximum pressure throughout the entire stroke. A constant effective area, and corresponding maximum pressure, is not required to move the diaphragm piston 3 in the early parts of the stroke, and therefore results in energy waste. A variable area architecture could be produced by telescopic cylinders or multiple pistons, among others. Multiple pistons can be in various arrangements including linear, staggered, or coextensive, and one or more pistons may be different sizes. This variant could be applied to any force coupled or force bias architectures.

Some embodiments of the system can also be operated in a reduced area mode where the exposed hydraulic area on one stage of a tandem system is less than on the second stage or vice versa. This could allow both stages to be operated with the same fixed pressure supply while providing different process gas discharge pressures. This allows operation at a more efficient pressure point for supply pumps of the HPU 118. This could allow for a reduced overall pressure rail variation as the load requirements of the system increase or decrease. FIGS. 16A-F illustrate embodiments of the variable area architecture 180.

Figure 16A:
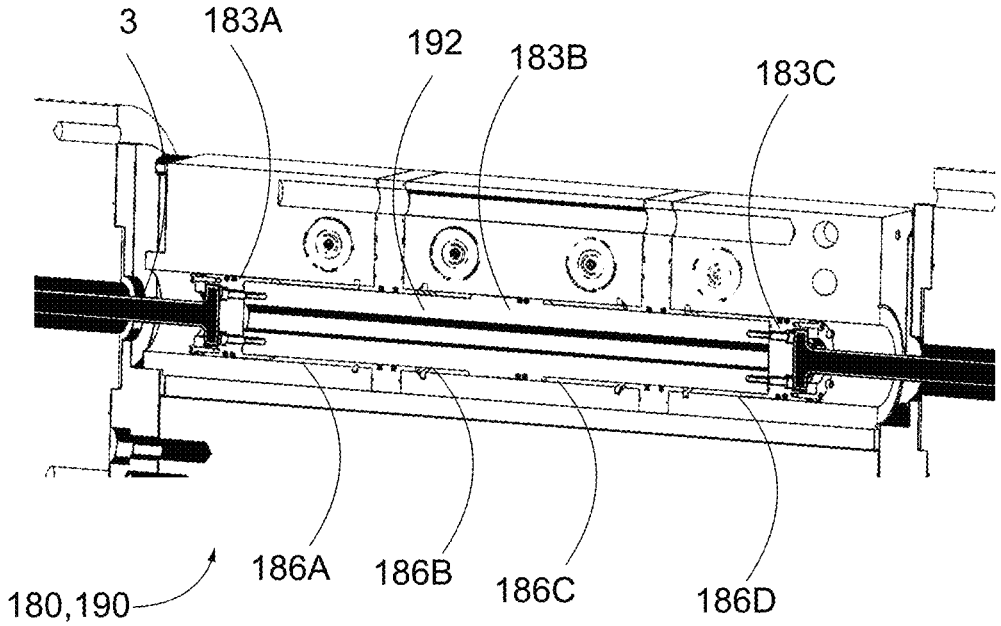
FIGS. 16A-F are views of variable piston arrangements for hydraulically-driven compressor systems in accord with embodiments of the present disclosure.

In some embodiments shown in FIG. 16A, a two-chamber force coupled linear actuator adds two additional pressurized cavities resulting in four total cavities 186A-D and three intermediate pistons 183A-C. For variable area operation, when driving the center piston 183B toward one compressor and diaphragm piston 3, pressurized fluid can be supplied to one or both of a primary cavity 186C or a secondary cavity 186D. In the illustrated embodiment, the hydraulic volume of the primary and secondary cavities 186C, 186D is equal. These two cavities 186C, 186D in other embodiments are sized with slightly different areas to provide an additional variable area functionality.

In still other embodiments, the variable area architecture 180 is a piston array, embodiments of which are shown in FIGS. 16B-E. As opposed to other embodiments using actuator pistons 166, 170 or intermediate pistons 183A-C that all share a common axis, a piston array uses a set of independent pistons that drive a common shaft (e.g., common drive shaft 172) but are not axially aligned. The array of pistons could act on a feature that is connected to the center drive shaft. The pistons could be operated as a single set in a fixed area mode or could be operated in any combination in a variable area mode.

Figure 16B:
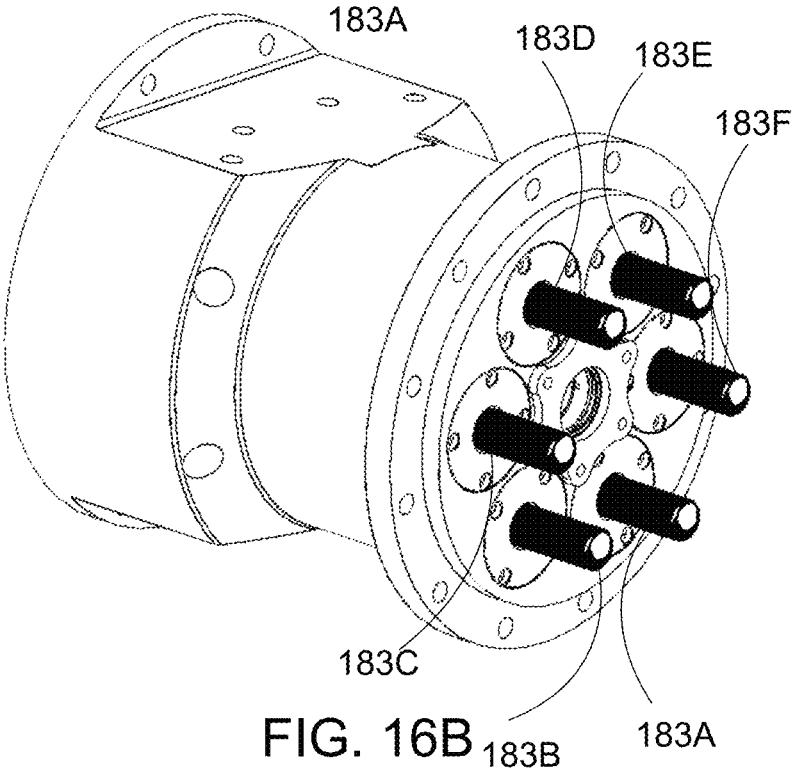
Figure 16C:
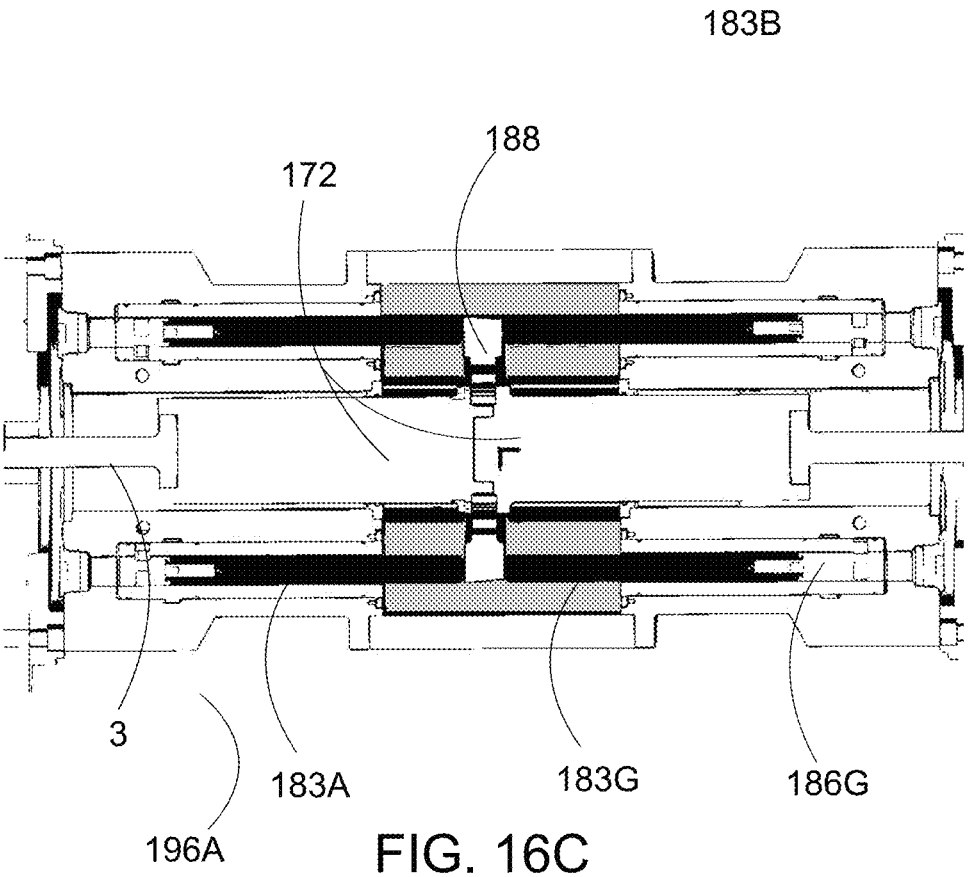

In one embodiment including an inward opposed piston array of FIGS. 16B-C, the intermediate pistons 183A-F are arranged in a circular pattern around a center drive shaft 172. Connected to the center drive shaft 172 is a drive plate 188 that all of the intermediate pistons 183A-F contact. In this inward opposed design there are two sets of intermediate pistons 183A-F, 183G-L that both push toward a center drive plate 188. Each of the intermediate pistons 183A-L has a corresponding drive cavity 186A-L (not all illustrated) that is operatively connected to the HPU 118 and/or the plurality of pressure rails 120. In certain embodiments, piston housings 196A, 196G are identical but face opposite directions. As one set of intermediate pistons 183A-F actuates, it drives the other intermediate pistons 183G-L to retract and pushes the drive shaft 172, which drives the diaphragm piston 3. In other embodiments, the arrays of intermediate pistons 183A-F and 183G-L may be controlled with the hydraulic drive 112 configured to control and actuate individual intermediate pistons (e.g., only intermediate piston 183A) or sub-groups of intermediate pistons (e.g., only intermediate pistons 183A, 183C, 183E). Likewise in embodiments the intermediate pistons 183A-L may individually or in sub-groups receive different supply pressures of work oil.

Figure 16D:
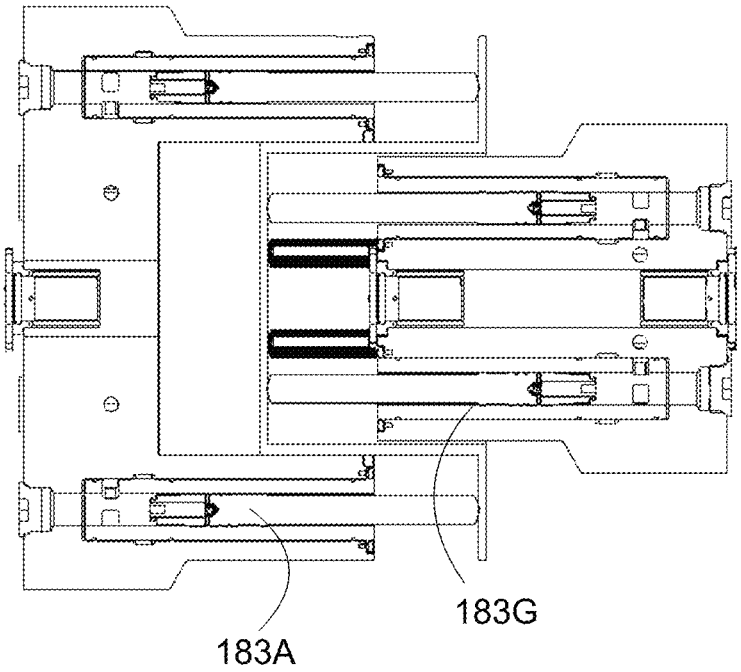

As shown in FIG. 16D, another embodiment of an inward opposed design uses a nested design 184 to reduce the overall length of the assembly. In this design, the two arrays of intermediate pistons 183A-F and 183G-L are not identical. Instead, one set of intermediate pistons 183A-F is arranged in a circular pattern with a larger diameter, large enough to allow for the opposing set of intermediate pistons 183G-L to nest within it.

Figure 16E:
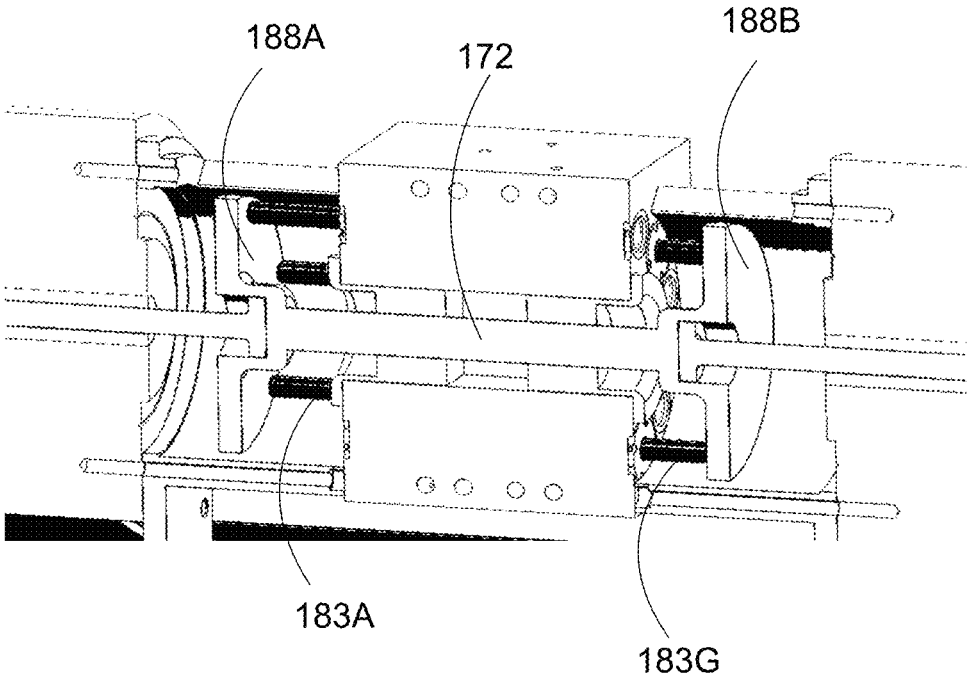

As shown in FIG. 16E, another embodiment of the piston array design uses a circular array of intermediate pistons 183A-L that are arranged around a central drive shaft 172 within a single housing. The direction of the individual pistons alternates around the circle with half of the intermediate pistons 183A-F pointing one direction and the other half 183G-L pointing the opposite. In this embodiment, there are two drive plates 188A, 188B connected to the common drive shaft 172. Actuation of this design is similar to those outlined above.

Figure 16F:
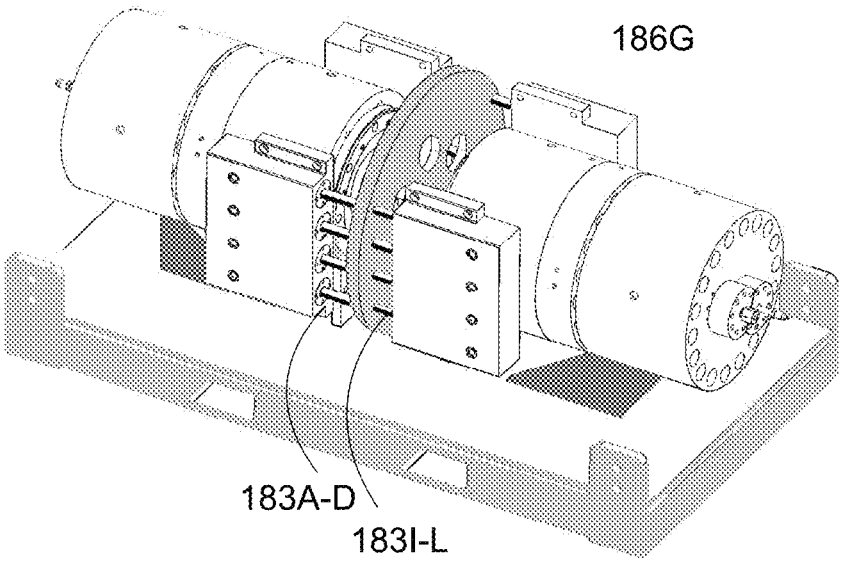

As shown in FIG. 16F, some embodiments of the piston array design employs arrays of intermediate pistons 183A-D, 183E-H, 1831-L, 183M-P situated outside of the compressor head footprint. These arrays each act on a single drive plate 188 connected to a single drive shaft (not shown). By moving the intermediate pistons 183A-P outside of the compressor head footprint, the length of the overall compressor system may be reduced. The intermediate piston arrays used in this assembly could be arranged in a circular pattern around the compressor heads or in a set of linear arrays position on either side of the pistons as shown in FIG. 16F. Actuation of this design is similar to those outlined above.

For any of the embodiments above, alternative embodiments may be provided as detailed for FIGS. 16B-C. In embodiments, the arrays of intermediate pistons may be controlled with the hydraulic drive 112 and configured to control and actuate individual intermediate pistons or sub-groups of intermediate pistons. Likewise in embodiments the intermediate pistons may individually or in sub-groups receive different supply pressures of work oil.

Active Oil Injection System

Figure 13:
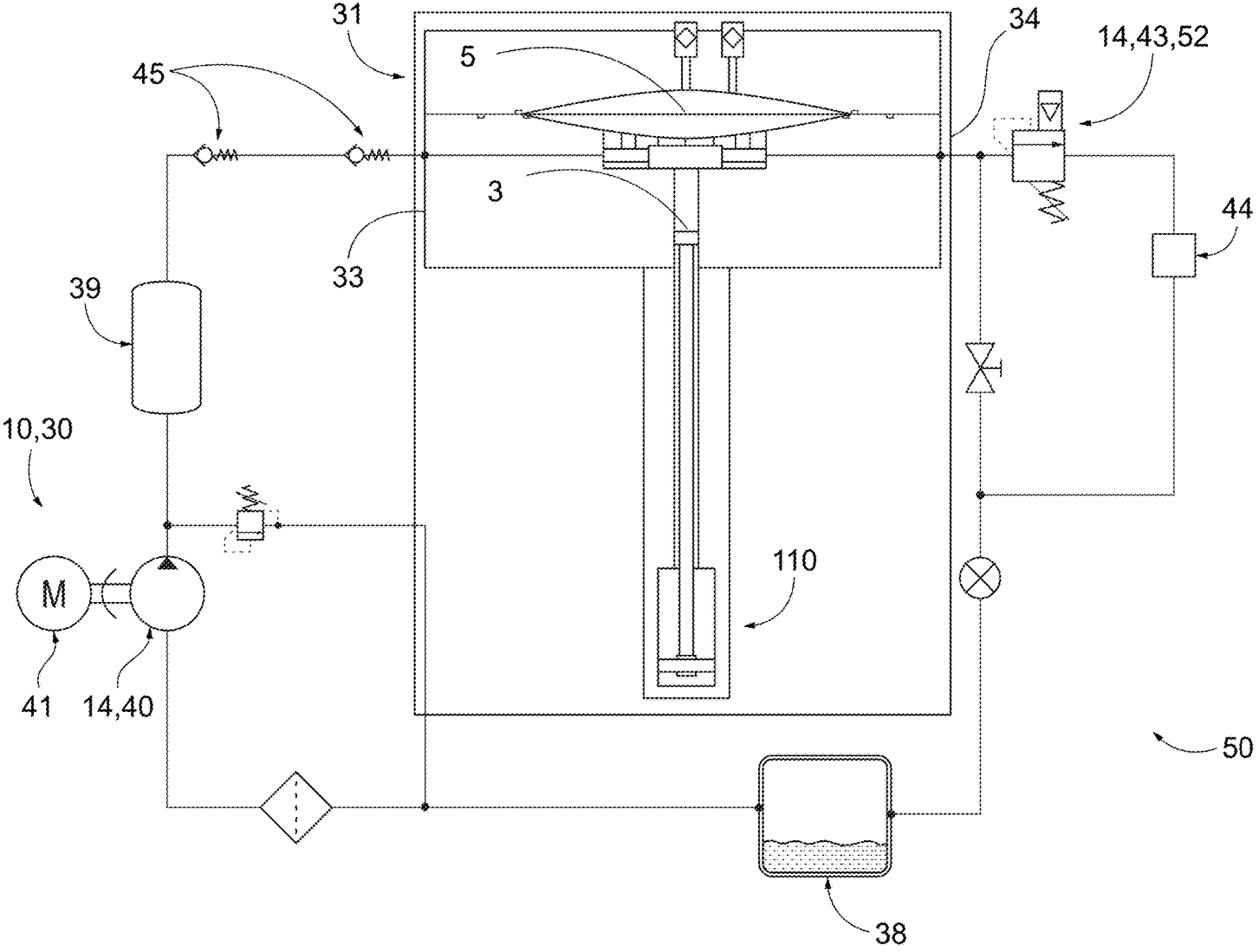
FIG. 13 is a schematic view of a hydraulically-driven compressor system with an active oil injection system in accord with embodiments of the present disclosure.

In some embodiments, the diaphragm compressor 1 employs a hydraulic injection pump system 10. The hydraulic injection pump system 10 comprises a pump 12, at least one oil check valves 13 and a fixed setting oil relief valve 14 as illustrated in FIG. 13. The injection pump system's 10 primary function is to maintain the required oil volume between the high-pressure oil piston 3 and diaphragm set 5. During the compressor's 1 suction stroke, a fixed volume of work oil is injected into the work oil region 35 of the compressor 1. This ensures a sufficient volume of oil is injected during each suction stroke to ensure the oil volume is maintained for proper compressor 1 performance.

In certain embodiments the oil volume between the diaphragm piston 3 and diaphragm 5 is impacted by two modes of oil loss. The first mode of oil loss is annular leakage past the diaphragm piston 3 back to the actuator housing 114 or an oil reservoir. This annular leakage may be most significant on high pressure compressors 1 operating above 5,000 psi.

The second mode of oil loss is defined as "overpump" which is hydraulic flow over the oil relief valve 14 that occurs every cycle during normal compressor 1 operation. The injector pump system 10 is designed and operated to maintain an "overpump" condition through the relief valve 14 ensuring the diaphragms 5 are sweeping the entire compressor cavity 15 (i.e., completely or substantially discharging process gas from the process gas region 36) thereby maximizing volumetric efficiency of the compressor 1. Embodiments of the present disclosure comprise an injection pump system 10 that is actively controlled, referred to as an active oil injection system ("AOIS") 30 as further discussed below.

Some embodiments of the injection systems 10 are mechanically adjustable by a user to vary the injector pump's 12 volumetric flow rate into the compressor 1. However, this requires manual observations and adjustment. An incorrect volumetric displacement from the injection pump system 10 that does not sufficiently account for oil losses can lead to various machine failures.

In certain embodiments, the hydraulic relief valve 14 has a manually adjustable relief setting. These oil relief valves are set to a fixed oil relief pressure setting that is higher than the maximum process gas pressure. The maximum process gas pressure is the maximum expected pressure of the process gas for any particular use case. This elevated relief setting allows the diaphragm 5 to contact the process gas head support plate 6 firmly before any work oil flows over the relief valve 14, thus, assuring a complete sweep of the entire volume of the head cavity 15 at the highest expected pressure of the process gas. When the diaphragm reaches the top of the head cavity 15, the diaphragm piston 3 still has a pressure below the setting of the relief valve 14. During this period, the work oil in the work oil region 35 compresses further and the hydraulic pressure rises above the compressor gas discharge pressure until it reaches the setting of the oil relief valve 14. At this point, the relief valve 14 opens and oil, in the amount of the injection pump displacement less the annular leakage in the system, is displaced over the oil relief valve 14. This oil flow out of the relief valve 14 is defined as overpump.

Certain embodiments of the present invention include an active oil injection system 30 ("AOIS") in a diaphragm compressor 1. The feedback and control of the AOIS 30 allow the compressor system 100 to minimize any excess energy used while ensuring the complete sweep of the diaphragm 5 discussed above.

In certain embodiments, the compressor 1 forms a hydraulic circuit 50 connecting the outlet 34 of the work oil head support plate 8 to the inlet 33 of the work oil head support plate 8. In those embodiments, the hydraulic circuit may also include an oil reservoir 38 configured to collect overpumped work oil from the work oil region 35 via the outlet 34 of the work oil head support plate 8. By forming a hydraulic circuit, oil is circulated from the oil reservoir 38, through the inlet 33 and into the work oil region, and then overpumped out the outlet 34 and back into the oil reservoir 38.

In other embodiments, the hydraulic circuit also includes an AOIS 30 including a hydraulic accumulator 39 configured to provide a supply of supplemental work oil to the inlet 33 of the work oil head support plate 8. In certain embodiments, the hydraulic accumulator 39 may be a hydraulic volume or any style of hydraulic accumulator 39 such as a bladder, piston, or diaphragm gas over fluid style hydraulic accumulator 39. In still further embodiments, the AOIS includes an AOIS pump 40 in communication with the hydraulic accumulator 39, the AOIS pump 40 configured to produce a variable volumetric displacement of the supplemental work oil from the oil reservoir 38 to the hydraulic accumulator 39 or directly to the inlet 33. As used herein, variable volumetric displacement means that the AOIS 30 can provide a variable volumetric flow, i.e. injection quantities of supplemental work oil, to the work oil region 35 depending on the particular process conditions of the compressor head 31. This allows for variable injection quantities during the compressor's 1 operation to maintain the compressor's 1 oil volume most efficiently within the compressor 1, and particularly the work oil region 35. In certain embodiments, the AOIS 30 includes the AOIS pump 40 operatively coupled to the hydraulic accumulator 39, and a motor 41 configured to power the AOIS pump 40 independently from the hydraulic drive 110. In other words, the speed and control of the motor 41 is completely independent from, and not mechanically linked to, the hydraulic drive 110 that powers the diaphragm piston 3.

In certain embodiments, the AOIS 30 utilizes the existing pressure dynamics within the compressor 1 to satisfy the hydraulic flow requirements into the compressor 1, and particularly into the work oil region 35. As the compressor 1 transitions through its suction and discharge cycles, the AOIS pump 40 charges and discharges the hydraulic accumulator 39. During the compressor's 1 suction stroke, this lower pressure condition within the compressor 1, including the work oil region 35, creates a positive pressure differential between the hydraulic accumulator 39 and the oil within the compressor head 31, and particularly in the work oil region 35. During this suction condition, hydraulic flow goes through the oil inlet check valves 45 and through inlet 33 into the work oil region 35 satisfying the injection event. During this time, the pump 40 may be continuously pumping into the hydraulic accumulator. During this discharge stroke, the hydraulic pressure within work oil region 35 is greater than the pressure in the hydraulic accumulator 39 therefore there is no flow from the hydraulic accumulator 39 into the compressor. At least one check valve 45, and in some embodiments at least two check valves 45, prevent backflow from the work oil region 35 into the hydraulic accumulator 39 and beyond. During this this condition, the hydraulic flow from the AOIS pump 40 pressurizes the hydraulic accumulator 39 in preparation for the next injection event.

Further embodiments include a variable pressure relieve valve (VPRV) 52, which includes a pressure relief mechanism 42 operatively coupled to the work oil region 35 of the diaphragm cavity 15, the pressure relief mechanism 42 including a pressure relief valve 43 in communication with the outlet 34 of the work oil head support plate 8 and configured to relieve an outlet volume of the pressurized work oil from the work oil region 35. In these embodiments, the pressure relief valve 43 includes a hydraulic relief setting corresponding to an overpump target condition of the pressurized work oil relative to the process gas discharge pressure. In some embodiments, the overpump target condition corresponds to a maximum process gas discharge pressure. In other words, the overpump target condition corresponds to a maximum process gas discharge pressure that the compressor head 31 is configured to operate at, so that the process gas region 36 is configured to be completely evacuated by the diaphragm 5 at maximum gas discharge pressure.

In certain embodiments, during an oil relief event during the discharge cycle, the relief valve 43 opens and oil, in the amount of the injection volume per revolution less the annular leakage in the system, is displaced over the oil relief valve 14, defined as overpump. During this time, the hydraulic flow from the AOIS pump 40 pressurizes the hydraulic accumulator 39 in preparation for the next injection event during the next suction cycle.

However, in certain embodiments, the pressure relief valve 43 is configured to actively adjust the hydraulic relief setting of the pressure relief valve to correspond to an overpump current condition. In other words, the pressure relief valve 43 is configured to adjust the hydraulic relief setting up or down corresponding to a relative increase or decrease in gas discharge pressure. This prevents the compressor head 31 from experiencing more overpump than necessary to completely evacuate the process gas region 36 by the diaphragm 5 under conditions with a gas discharge pressure less than the maximum gas discharge pressure. Adjustability of the hydraulic relief setting may enable longer machine life expectancy and better system efficiency due to lower cyclic stresses and lower alternating loads during the compressor's 1 discharge and suction cycles.

Certain embodiments of the AOIS 30 include an injector pump 40 and hydraulic accumulator 39 without a VPRV 52, while other embodiments include both systems.

In certain embodiments, the AOIS 30 includes a feedback mechanism configured to control the AOIS pump 40 to maintain the overpump target condition of the work oil region 35. The feedback mechanism includes a measurement device 44 that provides feedback to verify the over pump condition is being met to control the injector pump system 30. In certain embodiments, the feedback mechanism includes a first measurement device 44 operatively coupled to the diaphragm compressor 1, the measurement device configured to detect and/or measure the overpump current condition of the intensified work oil flowing out of the outlet 34 from the work oil region 35. In certain embodiments, the feedback mechanism is configured to adjust the volumetric displacement of the injector pump 40 to the hydraulic accumulator 39 in response to the overpump current condition.

Turndown ratio refers to the operational range of a device, and is defined as the ratio of the maximum capacity to minimum capacity. In certain embodiments of the AOIS 30, the AOIS is configured to provide a large turndown ratio of supplemental work oil relative to the work oil 4 in the work oil region 35 of the compressor 31. By separating the functions of the hydraulic drive 31 and the AOIS pump 40, a large turndown ratio can be achieved allowing for significant adjustability of injection quantity to tightly control the amount of overpump through the relief valve 43 over a wide range of operating conditions.

In embodiments, the overpump target condition ranges from 0.1%-500% above a measured process gas discharge pressure. In various embodiments, the overpump target condition ranges from about 0.1%-100% above, 0.1%-50% above, 0.1%-40% above, 0.1%-30% above, 0.1%-20% above, 1%-20% above, or 1%-50% above the measured process gas discharge pressure.

All of the features disclosed, claimed, and incorporated by reference herein, and all of the steps of any method or process so disclosed, may be combined in any combination, except combinations where at least some of such features and/or steps are mutually exclusive. Each feature disclosed in this specification may be replaced by alternative features serving the same, equivalent or similar purpose, unless expressly stated otherwise. Thus, unless expressly stated otherwise, each feature disclosed is an example only of a generic series of equivalent or similar features. Inventive aspects of this disclosure are not restricted to the details of the foregoing embodiments, but rather extend to any novel embodiment, or any novel combination of embodiments, of the features presented in this disclosure, and to any novel embodiment, or any novel combination of embodiments, of the steps of any method or process so disclosed.

It will be appreciated that embodiments of the present disclosure may comprise two pressure rails, or alternatively three, four, five, six, seven, or more pressure rails. In embodiments, there may be two or three low-pressure rails, or two or three sources for the low-pressure rail (e.g., two or three sources feeding an accumulator of the low-pressure rail). In embodiments, one or more of the medium-pressure rail(s) and high-pressure rail(s) may be fed by recovered oil similar to oil recovered in the accumulator 136D of the force bias architecture 160. In embodiments, one or more pistons of the piston subassembly 122 may be a shape other than circular, for example oval, square, rectangular, or the like.

Although specific examples have been illustrated and described herein, it will be appreciated by those of ordinary skill in the art that any arrangement calculated to achieve the same purpose could be substituted for the specific examples disclosed. This application is intended to cover adaptations or variations of the present subject matter. Therefore, it is intended that the invention be defined by the attached claims and their legal equivalents, as well as the illustrative aspects. The above described embodiments are merely descriptive of its principles and are not to be considered limiting. Further modifications of the invention herein disclosed will occur to those skilled in the respective arts and all such modifications are deemed to be within the scope of the inventive aspects.

What is claimed is:

1. A hydraulically-driven compressor system, comprising:

one or more diaphragm compressor heads, each of the one or more diaphragm compressor heads comprising:

a process gas head support plate comprising a process gas inlet and a process gas outlet, a work oil head support plate comprising a piston cavity, an inlet, and an outlet, a head cavity defined between the process gas head support plate and the work oil head support plate, and a metallic diaphragm mounted between the oil head support plate and the process gas head support plate, the metallic diaphragm dividing the head cavity into a work oil region and a process gas region, the metallic diaphragm configured to: actuate from a first position to a second position during a discharge cycle to pressurize process gas in the process gas region from an inlet pressure to a discharge pressure, and discharge the pressurized process gas through the outlet of the process gas head support plate, the metallic diaphragm configured to move from the second position to the first position during a suction cycle to fill the process gas region with process gas at the inlet pressure; and a hydraulic drive configured to intensify work oil and provide the intensified work oil to the compressor head, the hydraulic drive comprising:

a drive housing defining a drive cavity, wherein the hydraulic drive is configured to provide a variable-pressure supply of work oil to the drive cavity, a hydraulic power unit, a plurality of pressure rails comprising: a first pressure rail of work oil at a first pressure, a second pressure rail of work oil at a second pressure, and a third pressure rail of work oil at a third pressure, wherein the first pressure, the second pressure, and the third pressure are different, and a piston subassembly comprising:

a diaphragm piston mounted entirely in the drive cavity and comprising a first diameter, wherein a first variable volume region comprises the work oil region of the compressor head and is defined between the diaphragm piston and the diaphragm of a corresponding compressor head, and an actuator piston located entirely in the drive cavity and coupled to the diaphragm piston, the actuator piston comprising an actuator diameter, wherein, during a discharge cycle of the diaphragm compressor head: the variable-pressure supply of work oil is configured to drive the actuator piston toward the diaphragm piston, driving the diaphragm piston toward the corresponding diaphragm compressor head, thereby intensifying the work oil in the first variable volume region to an intensified pressure, the intensified work oil causing the diaphragm to actuate to the second position; and wherein, upon completion of the discharge cycle, the suction cycle is initiated due to one or more of: the intensified work oil in the first variable volume region decompressing, a supply of work oil from the first pressure rail being supplied to the drive cavity to act against the actuator piston, and a supply of process gas at the inlet pressure being supplied to the head cavity.

2. The hydraulically-driven compressor system of claim 1, wherein the first pressure rail comprises low-pressure work oil recovered from a previous cycle of the diaphragm compressor head.

3. The hydraulically-driven compressor system of claim 2, wherein the second pressure rail comprises medium-pressure work oil pressurized by the hydraulic power unit.

4. The hydraulically-driven compressor system of claim 1, wherein the hydraulic drive is configured to provide the variable-pressure supply of work oil by supplying work oil from the third pressure rail after work oil has been supplied from the first and second pressure rails.

5. The hydraulically-driven compressor system of claim 1, wherein the hydraulic drive is configured to provide the variable-pressure supply of work oil by sequentially providing work oil to the drive cavity from the first pressure rail, the second pressure rail, and the third pressure rail.

6. The hydraulically-driven compressor system of claim 5, the hydraulic drive further comprising a feedback mechanism configured to adjust one or more of the pressure and timing of the variable-pressure supply of work oil.

7. The hydraulically-driven compressor system of claim 6, the feedback mechanism comprising a sensor configured to detect one or more of the position and velocity of the actuator piston.

8. The hydraulically-driven compressor system of claim 1, wherein first pressure rail comprises low-pressure work oil from an oil reservoir of the hydraulic drive, the hydraulic drive further comprising:

a passive first valve configured to supply work oil from the first pressure rail to the drive cavity, an active second valve configured to supply work oil from the second pressure rail to the drive cavity, and an active third valve configured to supply work oil from the third pressure rail to the drive cavity, wherein one or more of the active second valve and the active third valve is configured to adjust from a supply stage to a return stage, the return stage permitting an outflow of intensified work oil from the drive cavity or the variable volume region during the suction cycle of the compressor head.

9. The hydraulically-driven compressor system of claim 1, the piston subassembly comprising a plurality of intermediate pistons configured to drive the diaphragm piston to intensify the work oil in the variable volume region.

10. The hydraulically-driven compressor system of claim 9, the plurality of intermediate pistons being axisymmetrically arranged about the actuator piston.

11. The hydraulically-driven compressor system of claim 1, further comprising an active oil injection system operatively coupled to the inlet of the work oil head support plate, the active oil injection system configured to provide a supplemental supply of work oil to the variable volume region to maintain an overpump condition of the compressor head.

12. The hydraulically-driven compressor system of claim 11, further comprising a pressure relief valve operatively coupled to the outlet of the work oil head support plate, the pressure relief valve configured to vent work oil from the variable volume to an oil reservoir, and wherein the first pressure rail comprises low-pressure work oil from the oil reservoir, and wherein the supplementary supply of work oil of the active oil injection system comprises work oil from the oil reservoir.

13. The hydraulically-driven compressor system of claim 1, the one or more diaphragm compressor heads comprising a second diaphragm compressor head comprising a second metallic diaphragm, configured to actuate from a first position to a second position during a second discharge cycle;

the hydraulic drive configured to, during a second discharge cycle, intensify work oil and provide the intensified work oil to the second diaphragm compressor head, the hydraulic drive further comprising:

the piston subassembly comprising:

a second diaphragm piston mounted in the drive cavity and comprising a second diameter, wherein a second variable volume region is defined between the second diaphragm piston and the second diaphragm of the second corresponding compressor head, wherein the actuator diameter is greater than the second diameter, and wherein, during a discharge cycle stroke of the second diaphragm piston and the second compressor head:

the variable-pressure supply of work oil is configured to drive the actuator piston toward the second diaphragm piston, driving the second diaphragm piston toward the corresponding second diaphragm compressor head, intensifying the work oil in the second variable volume region to an intensified pressure, and actuating the second diaphragm to the second position.

14. The hydraulically-driven compressor system of claim 13, wherein the piston subassembly is configured to reciprocate between the discharge cycle of the compressor head and the second discharge cycle of the second compressor head, and wherein the second discharge cycle of the second compressor head is concurrent with the suction cycle of the compressor head.

15. The hydraulically-driven compressor system of claim 13, wherein the second discharge cycle of the second compressor head is concurrent with the discharge cycle of the compressor head.

16. The hydraulically-driven compressor system of claim 13, wherein the compressor head and the second compressor head are arranged on axially opposed sides of the drive housing.

17. The hydraulically-driven compressor system of claim 16, wherein the diaphragm piston and the second diaphragm piston are coaxial with the actuator piston.

18. The hydraulically-driven compressor system of claim 13, wherein the diaphragm piston is operatively coupled to the actuator piston and the second diaphragm piston is operatively coupled to the actuator piston, and wherein, during the suction cycle to fill the process gas region of the compressor head with process gas at the inlet pressure, the metallic diaphragm is configured to move to the first position and initiate movement of the diaphragm piston toward the second compressor head.

19. A hydraulically-driven compressor system, comprising:

one or more diaphragm compressor heads, each of the one or more diaphragm compressor heads comprising:

a process gas head support plate comprising a process gas inlet and a process gas outlet, a work oil head support plate comprising a piston cavity, an inlet, and an outlet, a head cavity defined between the process gas head support plate and the work oil head support plate, and a metallic diaphragm mounted between the oil head support plate and the process gas head support plate, the metallic diaphragm dividing the head cavity into a work oil region and a process gas region, the metallic diaphragm configured to: actuate from a first position to a second position during a discharge cycle to pressurize process gas in the process gas region from an inlet pressure to a discharge pressure, and discharge the pressurized process gas through the outlet of the process gas head support plate, the metallic diaphragm configured to move from the second position to the first position during a suction cycle to fill the process gas region with process gas at the inlet pressure; and a hydraulic drive configured to intensify work oil and provide the intensified work oil to the compressor head, the hydraulic drive comprising:

a drive housing defining a drive cavity, wherein the hydraulic drive is configured to provide a variable-pressure supply of work oil to the drive cavity, a hydraulic power unit, the variable-pressure supply of work oil comprising a plurality of pressure rails comprising: a first pressure rail of work oil at a first pressure, and a second pressure rail of work oil at a second pressure, and a piston subassembly comprising:

a diaphragm piston mounted entirely in the drive cavity and comprising a first diameter, wherein a first variable volume region comprises the work oil region of the compressor head and is defined between the diaphragm piston and the diaphragm of a corresponding compressor head, an actuator piston located entirely in the drive cavity and coupled to the diaphragm piston, the actuator piston comprising an actuator diameter, wherein, during a discharge cycle of the diaphragm compressor head, the variable-pressure supply of work oil is configured to drive the actuator piston toward the diaphragm piston, driving the diaphragm piston toward the corresponding diaphragm compressor head, thereby intensifying the work oil in the first variable volume region to an intensified pressure, the intensified work oil causing the diaphragm to actuate to the second position; and a pressure relief valve operatively coupled to the outlet of the work oil head support plate, the pressure relief valve configured to vent work oil from the variable volume to an oil reservoir, and wherein the first pressure rail comprises work oil from the oil reservoir at the first pressure lower than the second pressure rail at the second pressure;

wherein, upon completion of the discharge cycle, the suction cycle is initiated due to one or more of: the intensified work oil in the first variable volume region decompressing, a supply of work oil from the first pressure rail being supplied to the drive cavity to act against the actuator piston, and a supply of process gas at the inlet pressure being supplied to the head cavity.

20. A hydraulically-driven compressor system, comprising:

one or more diaphragm compressor heads, each of the one or more diaphragm compressor heads comprising:

a process gas head support plate comprising a process gas inlet and a process gas outlet, a work oil head support plate comprising a piston cavity, an inlet, and an outlet, a head cavity defined between the process gas head support plate and the work oil head support plate, and a metallic diaphragm mounted between the oil head support plate and the process gas head support plate, the metallic diaphragm dividing the head cavity into a work oil region and a process gas region, the metallic diaphragm configured to: actuate from a first position to a second position during a discharge cycle to pressurize process gas in the process gas region from an inlet pressure to a discharge pressure, and discharge the pressurized process gas through the outlet of the process gas head support plate, the metallic diaphragm configured to move from the second position to the first position during a suction cycle to fill the process gas region with process gas at the inlet pressure; and a hydraulic drive configured to intensify work oil and provide the intensified work oil to the compressor head, the hydraulic drive comprising:

a drive housing defining a drive cavity, wherein the hydraulic drive is configured to provide a variable-pressure supply of work oil to the drive cavity, the variable-pressure supply of work oil comprising a plurality of pressure rails comprising: a first pressure rail of work oil at a first pressure, and a second pressure rail of work oil at a second pressure, and a hydraulic power unit comprising a first pump and a second pump, wherein the first pump is configured to supply the first pressure rail with work oil at the first pressure and the second pump is configured to supply the second pressure rail with work oil at a second pressure, and a piston subassembly comprising:

a diaphragm piston mounted entirely in the drive cavity and comprising a first diameter, wherein a first variable volume region comprises the work oil region of the compressor head and is defined between the diaphragm piston and the diaphragm of a corresponding compressor head, an actuator piston located entirely in the drive cavity and coupled to the diaphragm piston, the actuator piston comprising an actuator diameter, wherein, during a discharge cycle of the diaphragm compressor head the variable-pressure supply of work oil is configured to drive the actuator piston toward the diaphragm piston, driving the diaphragm piston toward the corresponding diaphragm compressor head, thereby intensifying the work oil in the first variable volume region to an intensified pressure, the intensified work oil causing the diaphragm to actuate to the second position;

wherein, upon completion of the discharge cycle, the suction cycle is initiated due to one or more of: the intensified work oil in the first variable volume region decompressing, a supply of work oil from the first pressure rail being supplied to the drive cavity to act against the actuator piston, and a supply of process gas at the inlet pressure being supplied to the head cavity.

* * * * *